US005911899A

United States Patent [19]

Yoshikai et al.

[11] Patent Number: 5,911,899

[45] Date of Patent: Jun. 15, 1999

[54] CORROSION-PROOF TRANSPARENT HEATER PANELS AND PREPARATION PROCESS THEREOF

[75] Inventors: Masaaki Yoshikai; Koichi Takahashi; Masato Koyama; Yuichiro Harada; Yoshihiro Sakai; Akemi Nakajima, all of Aichi-ken; Toshihiro Dodo, Kanagawa-ken, all of Japan

[73] Assignee: Mitsui Chemicals, Inc., Tokyo, Japan

[21] Appl. No.: 08/661,673

[22] Filed: Jun. 11, 1996

[30] Foreign Application Priority Data

Jun. 15, 1995 [JP] Japan ..... 7-148600

[51] Int. Cl.[6] ..... H05B 3/06

[52] U.S. Cl. ..... 219/522; 219/528; 219/530

[58] Field of Search ..... 219/528, 202, 219/547, 203, 548, 546

[56] References Cited

U.S. PATENT DOCUMENTS

| | | | |
|---|---|---|---|
| 2,584,859 | 2/1952 | Gaiser et al. . | |
| 4,414,254 | 11/1983 | Iwata | 428/34 |
| 5,028,759 | 7/1991 | Finley . | |
| 5,075,535 | 12/1991 | Hans et al. . | |
| 5,099,104 | 3/1992 | Holzer et al. . | |
| 5,448,037 | 9/1995 | Takase | 219/547 |
| 5,493,102 | 2/1996 | Takase | 219/547 |

FOREIGN PATENT DOCUMENTS

| | | |
|---|---|---|
| 0252489 | 1/1988 | European Pat. Off. . |
| 0367209 | 5/1990 | European Pat. Off. . |
| 0582457 | 2/1994 | European Pat. Off. . |
| 0609088 | 8/1994 | European Pat. Off. . |

*Primary Examiner*—Teresa J. Walberg
*Assistant Examiner*—Quan Nguyen
*Attorney, Agent, or Firm*—Burns, Doane, Swecker & Mathis, L.L.P.

[57] ABSTRACT

A transparent heater panel having a transparent substrate, a transparent conductive layer formed on the transparent substrate, electrodes formed on the transparent conductive layer and a transparent protective layer formed on the transparent conductive layer except portions reserved for the electrodes with the end faces of the transparent conductive layer corrosion treated with a transparent protective plastic member or an anticorrosive; and a process for producing the same. The heater panel has improved durability against pollutants, environmental durability, reliability and light transmission.

28 Claims, 17 Drawing Sheets

CORROSION-PROOF TRANSPARENT HEATER PANELS AND PREPARATION PROCESS THEREOF

BACKGROUND OF THE INVENTION (1) Field of the Invention

The present invention relates to transparent heater panels and a process for preparing the same. More particularly, it relates to transparent heater panels which can be used for window portions, especially transparent heater panels which can be used for liquid crystal displays, refrigerator showcases, freezer showcases, defrosters of cars, and a process for preparing the same.

(2) Description of the Related Art

In freezer showcases and refrigerator showcases, it is necessary to prevent dew condensation on the surface of a windowpane in the window portion. Therefore, a transparent conductive layer was formed on the surface of a windowpane to apply predetermined electric power to the transparent conductive layer and heat the windowpane's surface.

The demand for liquid crystal displays has increased these days. Their operation is, however, inconveniently slow when they are used in cold areas. Thus there has also been an increased need for transparent heater panels with liquid crystal displays for temperature control. Heretofore, in liquid crystal displays used in cold areas, exothermic resistors for heating were used, as disclosed in, for example, JP-A-58-126517 (Tokkaisho). It was, however, difficult to uniformly heat the whole liquid display using one of the constitutions, and the exothermic resistors comprising an opaque metal tended to inconveniently disturb an operator in watching the display.

Transparent heating elements in which transparent conductive layers are formed on transparent substrates are disclosed in, for example, U.S. Pat. No. 4,952,783. One of such heating elements is in FIG. 31 attached hereto. A transparent conductive layer 52 is formed on the whole surface of a transparent substrate 51, and a pair of electrodes 53 and 53' for applying an electric power to the transparent conductive layer 52 are formed over both edge portions of the transparent conductive layer 52. Furthermore, a transparent protective layer 54 is formed on the whole surface of the heating element to protect the transparent conductive layer 52 and the electrodes 53 and 53'. The electrodes 53 and 53' are formed by coating suitable portions of the transparent conductive layer 52 with a conductive printing material such as a silver paste using a screen printing method, and then thermally treating the resulting coated material. For the purpose of improving the reliability of the electrodes, JP-A-4-289685 (Tokkaihei) discloses electrodes sandwiching a metal foil with electrically conductive printing material layers.

The present inventors found that a transparent heater panel is obtained by forming a substantially light-transmittable metallic thin layer on a transparent conductive layer and then forming a pair of metallic electrodes on the metallic thin layer using a wet plating process, as disclosed in JP-A-6-283260 (Tokkaihei). Typical examples of transparent conductive layers used for transparent heater panels are laminates in which a metallic thin layer is held between transparent thin layers of high refractive index. This application also discloses laminates having a sandwiched structure such as InOx/Ag/InOx, SiNx/Ag/SiNx or $TiO_2$/Ag/$TiO_2$, which is formed by a vacuum deposition method, reactive deposition method or sputtering deposition method. When a metallic thin layer containing silver as a main component is used for a metallic layer of a laminate, the resulting laminate has particularly excellent transparency in the visible light range, better conductivity, especially excellent heating performance at a low electric voltage.

In a transparent heater panel whose laminate is covered by a transparent thin layer of high refractive index, and which comprises a thin layer containing silver or copper as a main component and is used as an exothermic body, there is a demand for severe environmental durability when the heater panel is used for the temperature compensation of a liquid crystal display in a car and the like. In particular, there are demands for moisture-heat resistance, heat resistance and cold resistance. In estimation of its moisture-heat resistance, in particular, fine silver particles are generated and coagulated, and they cause the thin layer of silver to deteriorate. Due to such deterioration, the heater panel is dotted with white spots resulting from the coagulation of fine silver particles, its appearance is deteriorated and the generation of heat is not uniform.

Therefore, conventional transparent heater panels are protected by their substrates and protective resins for the purpose of preventing their thin layers of silver from deteriorating. However, when transparent heater panels protected like that are tested for environmental durability, their thin layers of silver are deteriorated. That is, they do not have sufficient environmental durability. In a transparent heater panel in which a thin layer of a semiconductor such as indium oxide is used as an exothermic layer, even if both surfaces are protected, the deterioration of the heater panel is hastened in the presence of acid components, and so on. That is, such a heater panel does not have sufficient environmental durability.

As mentioned above, in transparent heater panels with both surfaces protected, the study of the cause of such deterioration and the solution thereof have been extremely important problems.

SUMMARY OF THE INVENTION

A general object of the present invention is to study the cause of such deterioration in order to solve, that is, to provide transparent heater panels having improved durability against pollutants such as hygroscopic moisture, dust, gases, acid substances and others, excellent environmental durability, high reliability, high light transmission, excellent heating performance and uniform heating performance.

Another object of the present invention is to provide a process for producing the same.

The present inventors earnestly studied the cause of such deterioration to solve the above-mentioned problems and found that such deterioration happens in the cut end faces of a heater panel which are not protected at all and spreads to any direction in its surface. Then, the present inventors found that, as a measure against such deterioration, in a transparent heater panel with a transparent conductive layer formed on a transparent substrate and a pair of electrodes to apply electric power to the transparent conductive layer, anticorrosive treatment such as covering the cut end faces of the transparent conductive layer with a transparent protective plastic member or an anticorrosive prevents the above-mentioned deterioration.

That is, a first object of the present invention can be achieved by a transparent heater panel comprising, in combination:

(1) a transparent substrate;

(2) a transparent conductive layer formed on a first surface of the transparent substrate;

(3) a first electrode extending over a first edge portion of the transparent conductive layer, and a second electrode extending over a second edge portion of the transparent conductive layer spaced from and opposite from the first edge portion thereof; and (4) a transparent protective layer formed over the portion of the transparent conductive layer, where neither the first electrode nor the second electrode is to be formed, each of the end faces of the transparent conductive layer being anticorrosion treated.

A second object of the present invention can be achieved by a process for preparing a transparent heater panel which comprises, in combination:

(1) a transparent substrate;

(2) a transparent conductive layer formed on a first surface of the transparent substrate;

(3) a first electrode extending over a first edge portion of the transparent conductive layer, and a second electrode extending over a second edge portion of the transparent conductive layer spaced from and opposite from the first edge portion thereof; and (4) a transparent protective layer formed over the portion of the transparent conductive layer, where neither the first electrode nor the second electrode is to be formed, the process comprising a step of corrosion treating each of the end faces of the transparent conductive layer.

As a further embodiment, one can optionally cover each of the end faces of the transparent conductive layer with a protective plastic member or an anticorrosive.

BRIEF DESCRIPTION OF THE DRAWINGS

The construction, operation and advantages of the transparent heater panels of the present invention are set forth in the detailed description by reference to the following drawings.

DETAILED DESCRIPTION OF PREFERRED EMBODIMENTS

Figure 1:
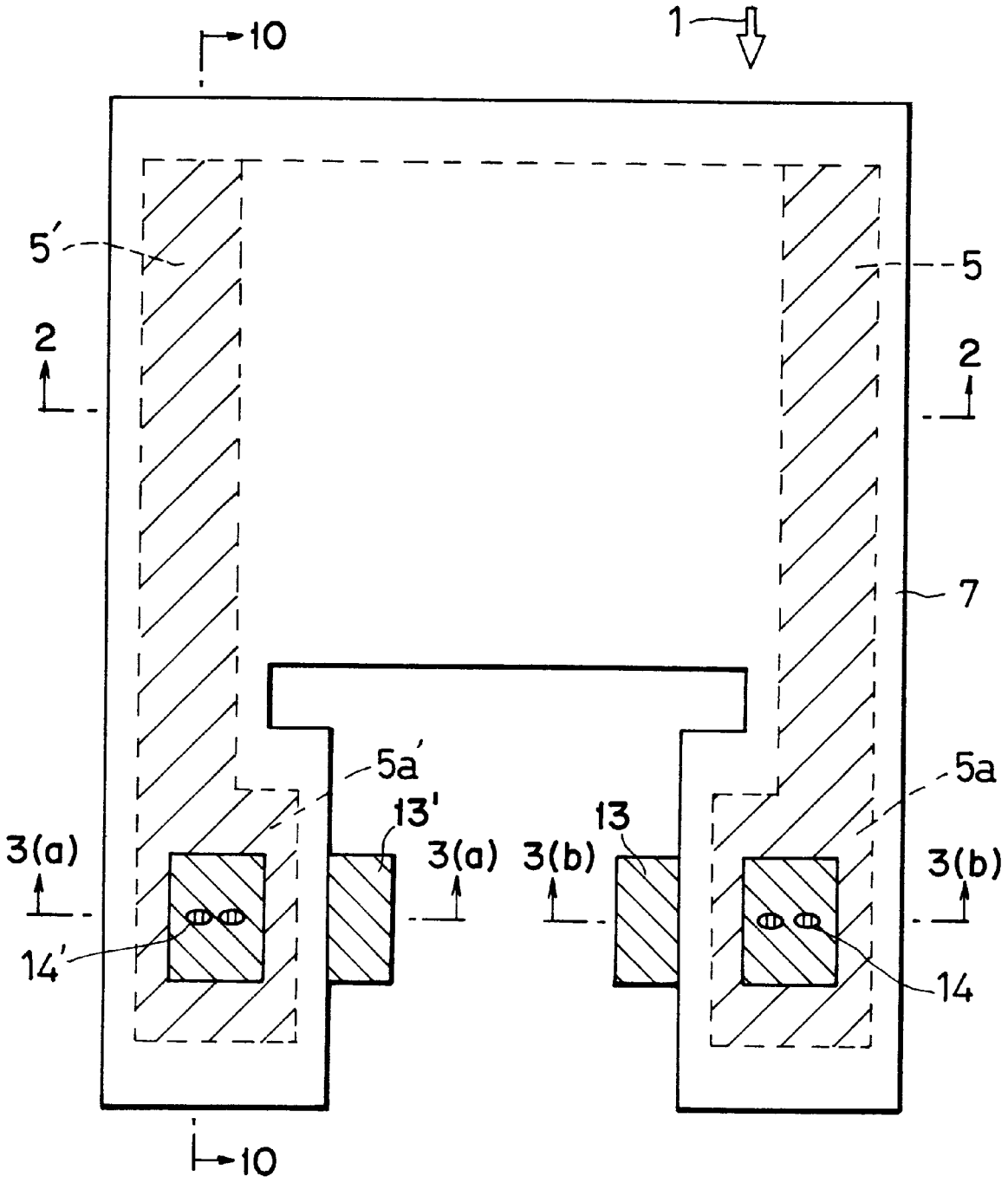
FIG. 1 is a plan view illustrating a first preferred embodiment of a transparent heater panel of the present invention.

Preferred embodiments of the present invention will be described as follows.

The structure of transparent heater panels of the present invention, which are to be corrosion treated with a transparent protective plastic member, will be first described.

(a) First Embodiment; FIGS. 1 to 4

A transparent heater panel 1 described in FIGS. 1 to 4 comprises a main portion which is nearly quadrangular and projected portions connected with outer power sources which are projected along the extended lines of electrodes over both the edge portions of the main portion. In other words, it comprises a transparent substrate 2, a transparent conductive layer 3 which is formed on a first surface of the transparent substrate 2 to be an exothermic body, a peripheral edge portion of the transparent substrate 2 reserved for the formation of a transparent protective plastic member 7 being excluded from the first surface, a pair of electrodes 5 and 5' formed over edge portions of the transparent conductive layer 3 to apply an electric power to the transparent conductive layer 3 and a transparent protective layer 6 formed over the portion of the transparent conductive layer 3, where the electrodes 5 and 5' are not to be formed, the transparent protective plastic member 7 being formed over the transparent protective layer 6, the electrodes 5 and 5' and the end faces of the transparent conductive layer 3 and the electrodes 5 and 5', and sticking to the upper face of the peripheral edge portion of the transparent substrate 2.

The transparent an protective plastic member 7 fulfills its anticorrosive function to protect the end faces of the transparent conductive layer 3 and the electrodes 5 and 5' from hygroscopic moisture, dust, gases, acid substances and other contaminants and improves the transparent heater panel 1 in environmental durability.

Each of the electrodes 5 and 5' is in the form of a rectangle which is narrow in width and long in length. One end of each of the electrodes 5 and 5' is a connecting section 5*a* or 5*a'*. The connecting sections 5*a* and 5*a'* each are formed to connect a wire for applying an electric power to the electrodes 5 and 5', respectively. Outerly connected metallic fittings 13 and 13' are mounted on the connecting sections 5*a* and 5*a'* with eyelets 14 and 14', respectively. The connecting sections 5*a* and 5*a',* in addition to the fittings 13 and 13', are projected from the main portion of the transparent heater panel 1 to a direction in its surface, the main portion being virtually in the form of a quadrangle. The present invention is, however, not limited to this type. The connecting sections 5*a* and 5*a'* may be projected in any of directions optionally selected and may not be projected at all.

Figure 5:
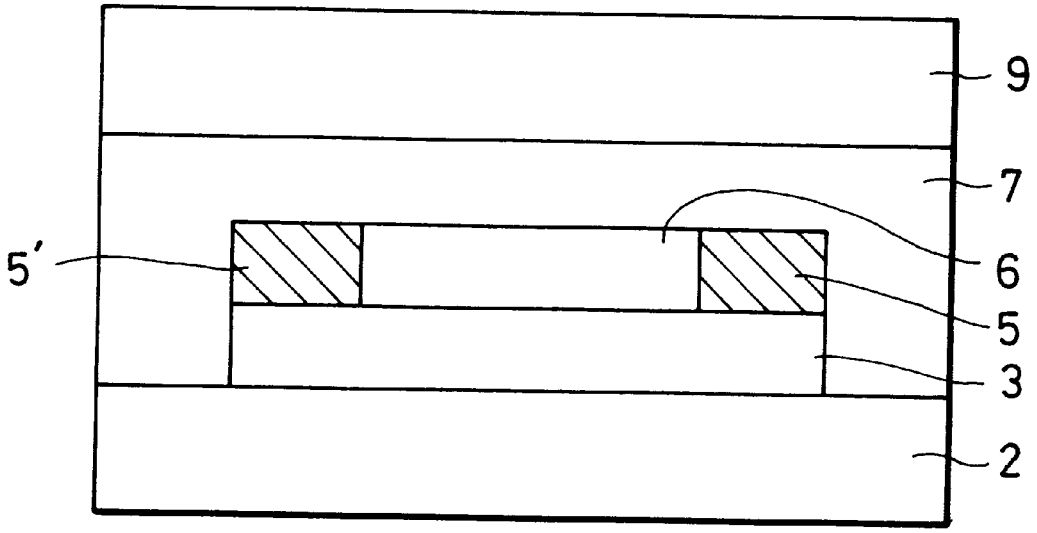
FIG. 5 is a transverse sectional view similar to FIG. 2 which illustrates a second preferred embodiment of a transparent heater panel of the present invention.

(b) Second Embodiment; FIG. 5

A transparent protective plastic film 9 is joined to the upper surface of a transparent protective plastic member 7 by means of an adhesive layer which is not shown in the figure.

Figure 6:
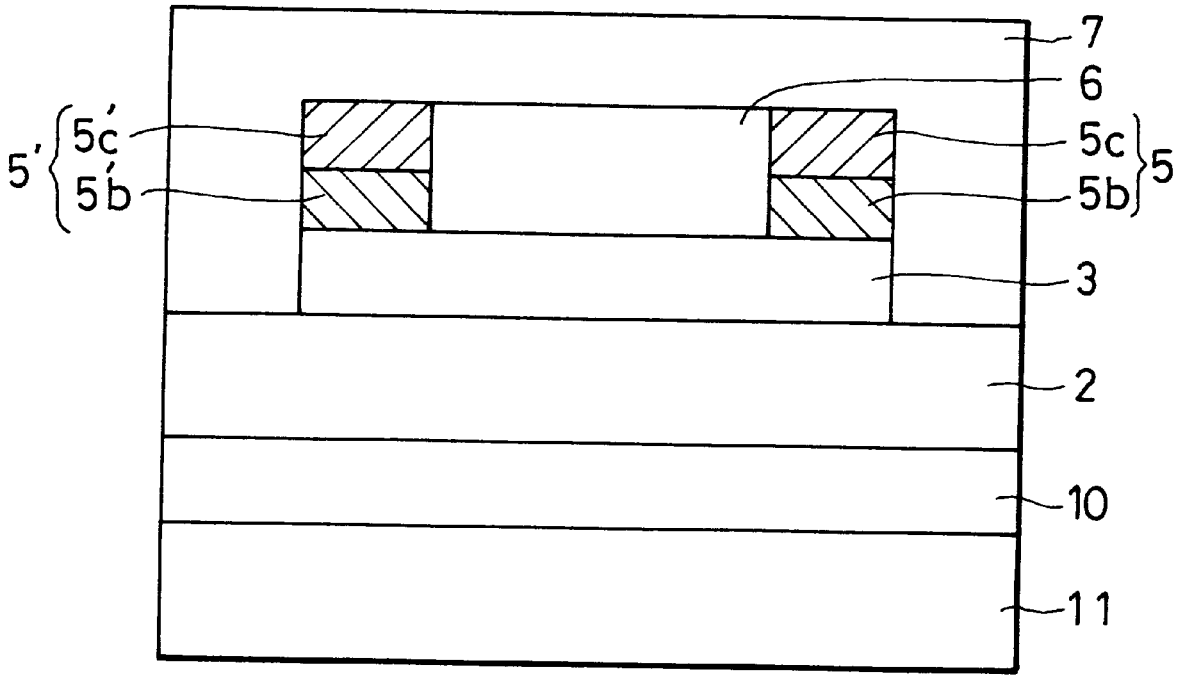
FIG. 6 is a transverse sectional view similar to FIG. 2 which illustrates a third preferred embodiment of a transparent heater panel of the present invention.

(c) Third Embodiment; FIG. 6

Electrodes 5 and 5' consist of conductive resin layers 5*b* and 5*b'* and plating layers 5*c* and 5*c',* respectively. An adhesive layer 10 is formed on a second surface of a transparent substrate 2 where a transparent conductive layer 3 is not to be formed and a separator or release sheet 11 is laminated on the adhesive layer 10. In this embodiment, the separator or release sheet 11 is peeled off and then the transparent heater panel 1 is joined to an outer support structure by contacting the surface of the adhesive layer 10 with the outer support structure by pressure.

Figure 7:
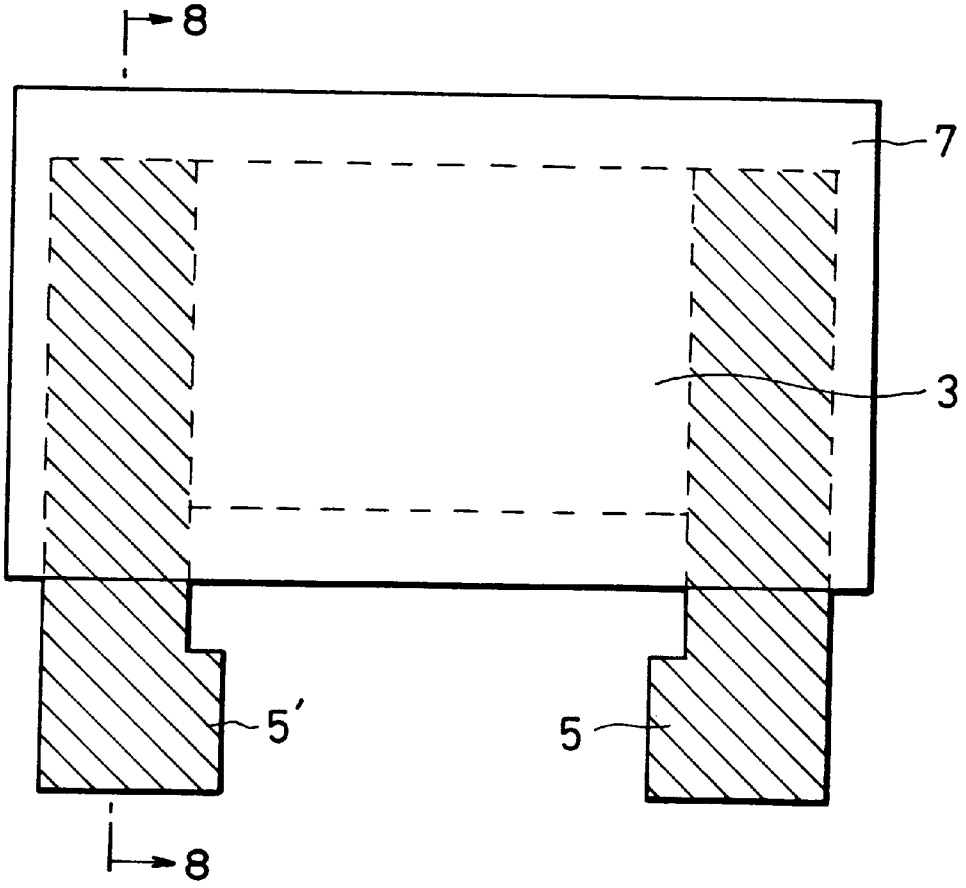
FIG. 7 is a plan view illustrating a fourth preferred embodiment of a transparent heater panel of the present invention.
Figure 8:
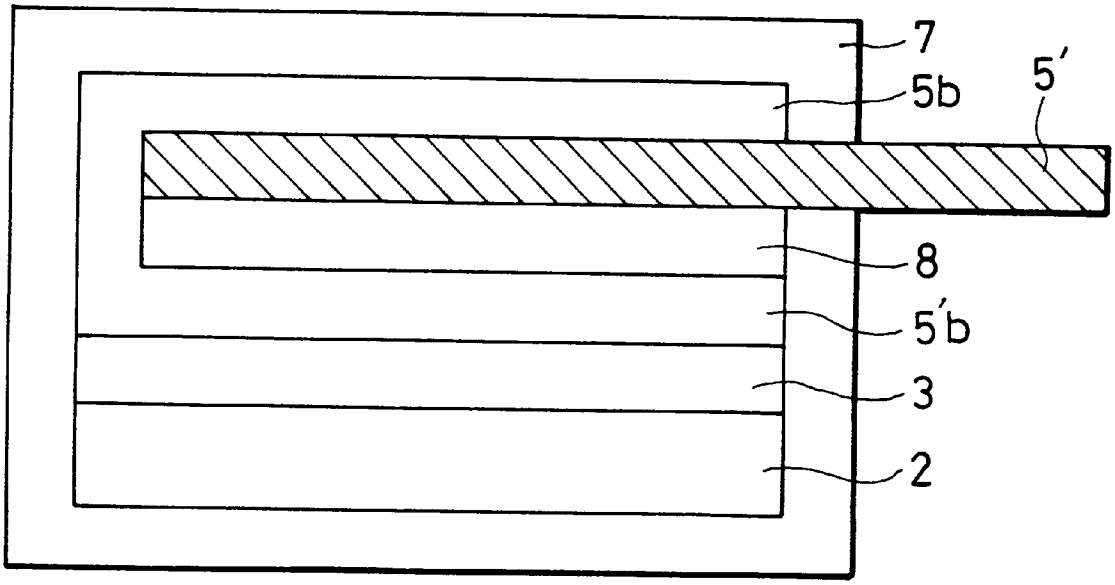
FIG. 8 is a longitudinal sectional view taken on line 8—8 of FIG. 7.

(d) Fourth Embodiment; FIGS. 7 and 8

Connecting sections for applying an electric power consist of only electrodes 5 and 5' consisting of foils of a metal such as copper. A transparent conductive layer 3 constituting an exothermic body is formed on the entire surface of a transparent substrate 2. A transparent conductive resin layer (conductive paste layer) 5*b,* an adhesive layer 8, electrodes 5 and 5' and another transparent conductive resin layer (conductive paste layer) 5*b* are formed on the transparent conductive layer 3 in order. The edge portions of the upper and lower conductive resin layers 5*b* are electrically connected with each other. The entire upper and lower surfaces and end faces of the main portion of the heater panel are covered by a transparent protective plastic member 7, so that the main portion is protected from contaminants and is prevented from corroding.

Figure 9:
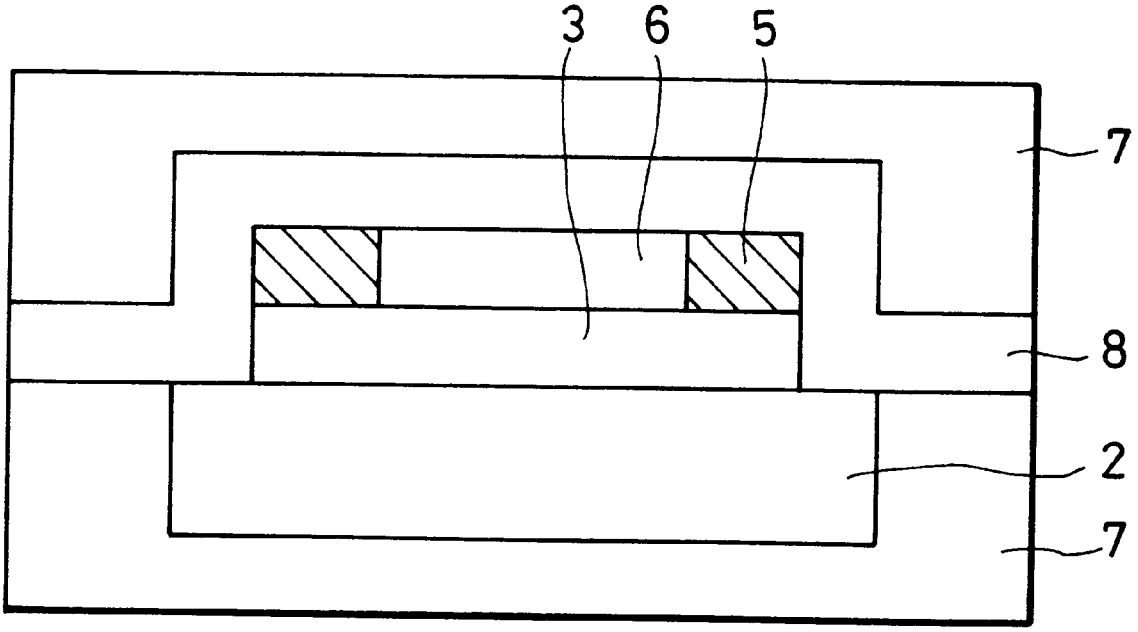
FIG. 9 is a transverse sectional view similar to FIG. 2 which illustrates a fifth preferred embodiment of a transparent heater panel of the present invention.

(e) Fifth Embodiment; FIG. 9

A transparent protective plastic member 7 covers, via an adhesive layer 8, the upper surface of a transparent protective layer 6, the upper surfaces of electrodes 5 and 5', and the end faces of the electrodes 5 and 5' and a transparent conductive layer 3 to protect the main portion of the heater panel from contaminants. Another transparent protective plastic member 7 also covers the lower surface and side faces of a transparent substrate 2 to prevent the main portion from corroding. The upper and lower transparent protective plastic members 7 are joined to each other via an adhesive layer 8 in peripheral edge portions of the heater panel.

Figure 10:
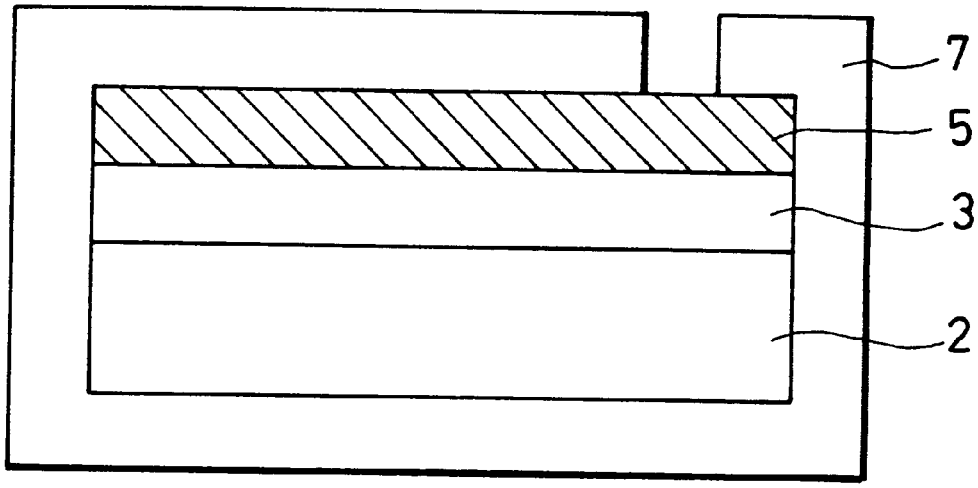
FIG. 10 is a longitudinal sectional view taken on a line corresponding with line 10—10 of FIG. 1 which illustrates a sixth preferred embodiment of a transparent heater panel of the present invention.

(f) Sixth Embodiment; FIG. 10

A transparent protective plastic member 7 covers electrodes 5, a transparent conductive layer 3 and a transparent substrate 2 except portions reserved for the formation of the electrodes 5.

Figure 11:
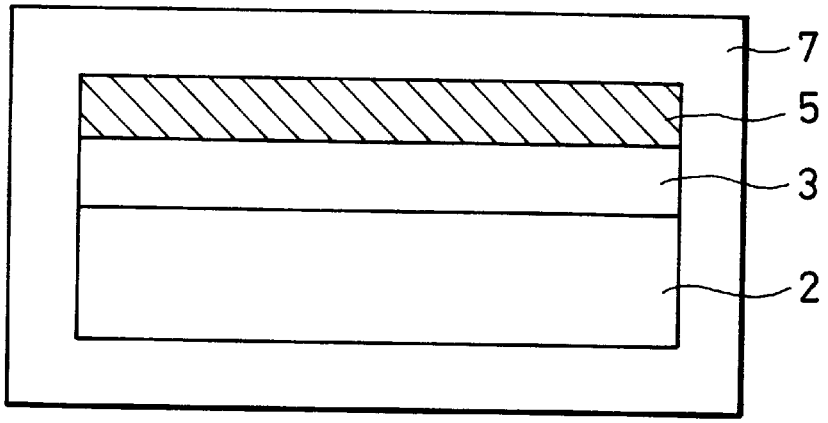
FIG. 11 is a longitudinal sectional view similar to FIG. 10 which illustrates a seventh preferred embodiment of a transparent heater panel of the present invention.

(g) Seventh Embodiment; FIG. 11

A transparent protective plastic member 7 covers the whole of electrodes 5, a transparent conductive layer 3 and a transparent substrate 2. The transparent protective plastic member 7 is removed using a suitable means such as heat treatment to install the electrodes 5.

Figure 12:
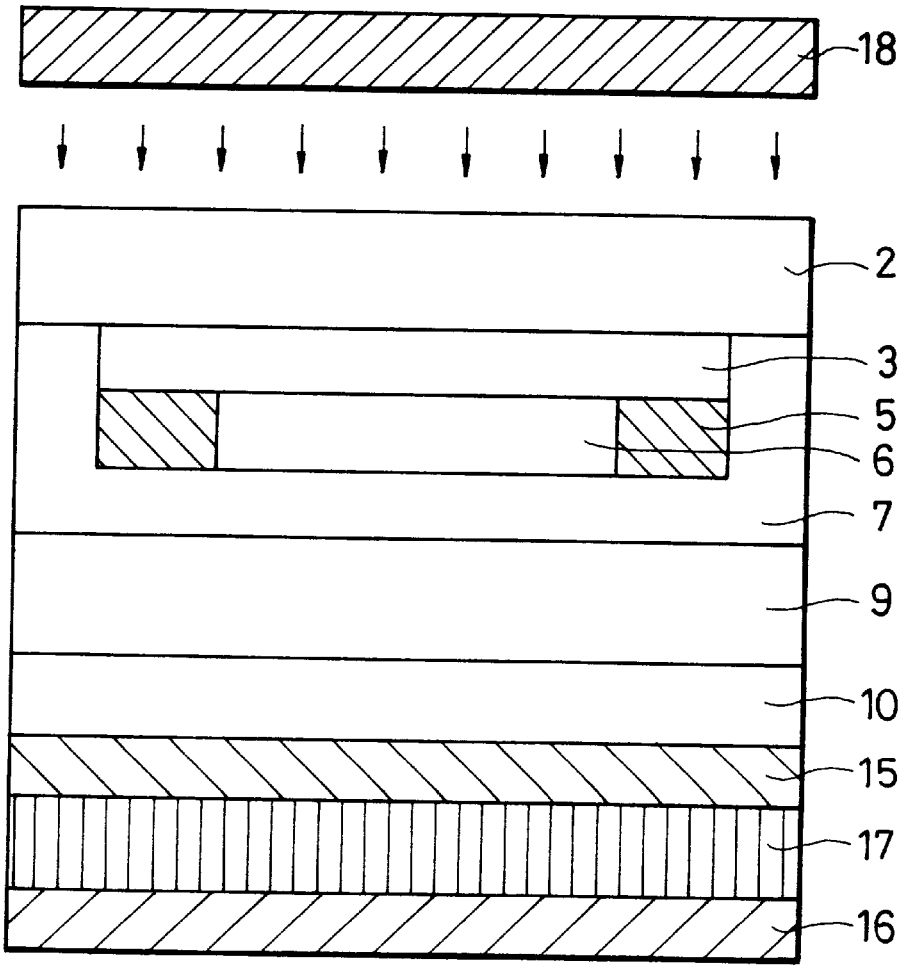
FIG. 12 is a transverse sectional view illustrating a second preferred embodiment of a transparent heater panel of the present invention which is particularly mounted on a support structure.

(h) Application of Second Embodiment; FIG. 12

A transparent heater panel as described in FIG. 5 and a liquid crystal display element are united together. This figure shows an embodiment which is formed by contacting a polarizing plate (P) 15 with a transparent protective plastic film 9 by pressure via an adhesive layer 10 to adhere a liquid crystal display having a structure of polarizing plate (P) 15/liquid crystal display element 17/polarizing plate (Q) 16 to the transparent protective plastic film 9. The embodiment also has a structure in which light from a backlight 18 is transmitted from the side of a transparent substrate 2 and is then used.

Next, the structure of a transparent heater panel of the present invention will be described when the heater panel is corrosion treated with an anticorrosive.

Figure 13:
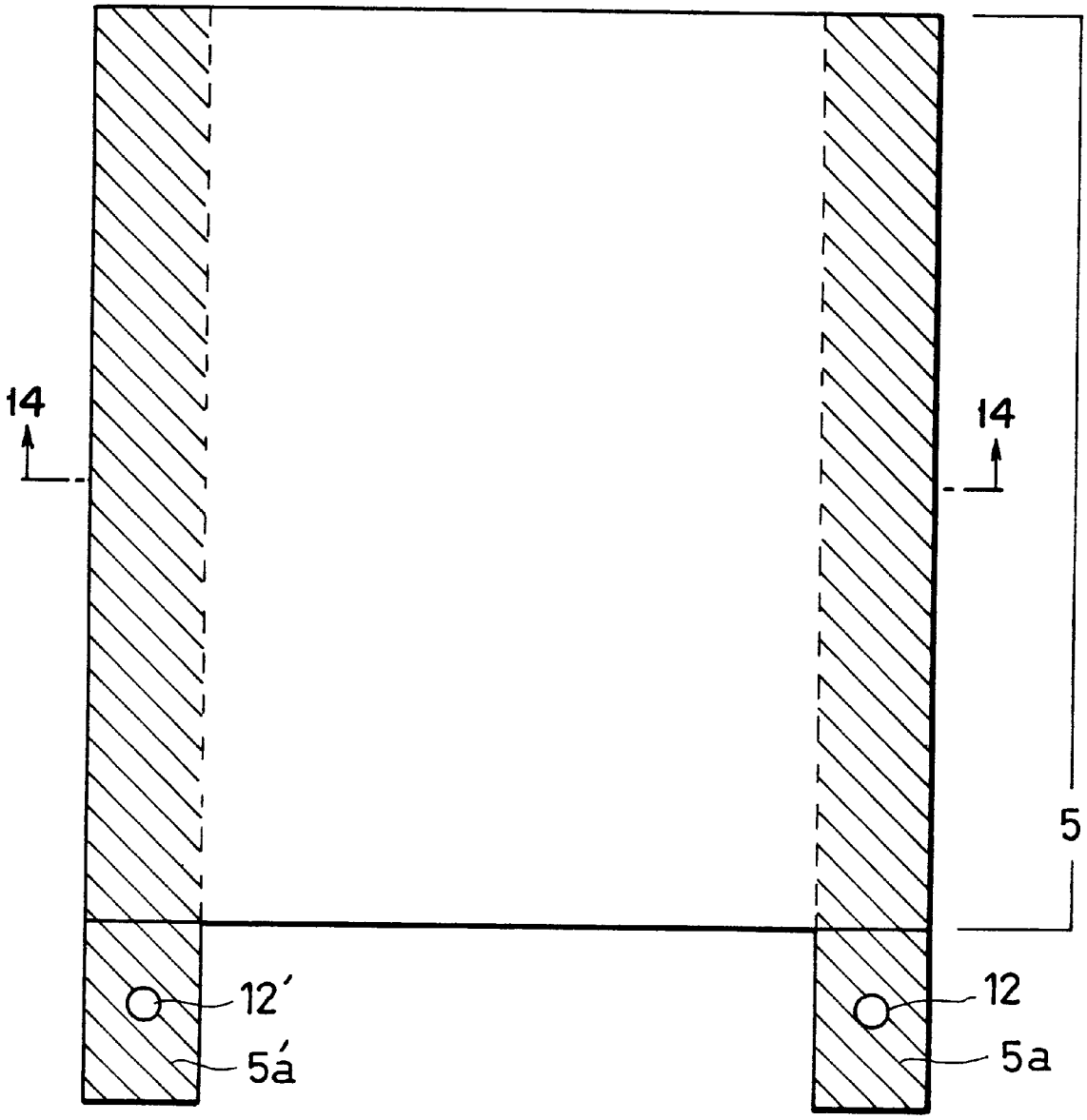
FIG. 13 is a plan view illustrating an eighth preferred embodiment of a transparent heater panel of the present invention.
Figure 14:
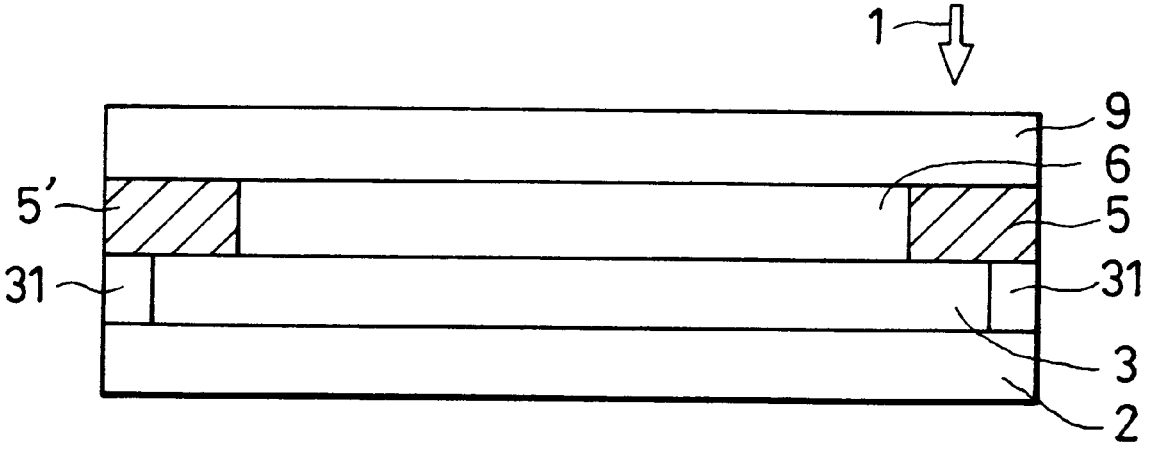
FIG. 14 is a transverse sectional view taken on line 14—14 of FIG. 13.
Figure 15:
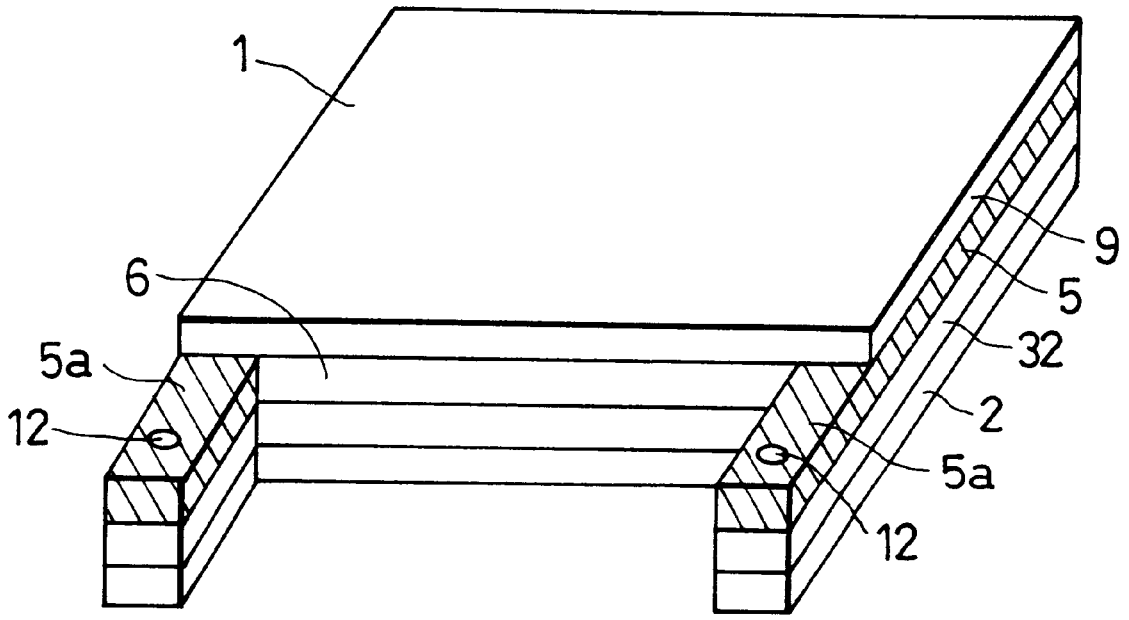
FIG. 15 is a perspective view of the heater panel of FIG. 13.

(i) Eighth Embodiment; FIGS. 13 to 15

A transparent heater panel 1 described in FIGS. 13 to 15 comprises a main portion which is nearly quadrangular and projected portions connected with outer power sources which are projected along the extended lines of electrodes over both the edge portions of the main portion. In other words, it comprises a transparent substrate 2, a transparent conductive layer 3 which is formed on a first surface of the transparent substrate 2 to be an exothermic body, a pair of electrodes 5 and 5' formed over edge portions of the transparent conductive layer 3 to apply an electric power to the transparent conductive layer 3 and a transparent protective layer 6 formed over the upper surface of the transparent conductive layer 3, where the electrodes 5 and 5' are not to be formed, and a transparent protective plastic film 9 covering the upper surface of the transparent protective layer 6 and the upper surfaces of the electrodes 5 and 5'. Such lamination is, however, carried out without an adhesive layer. The end faces of the transparent conductive layer 3 are corrosion treated. That is, they are covered with an anticorrosive component 31 layer. The electrodes 5 and 5' each are in the shape of a rectangle which is narrow in width and long in length. One end of each of the electrodes is a connecting section 5*a* or 5*a'*. Holes 12 and 12' for eyelets are formed in the connecting sections 5*a* and 5*a',* respectively, so that the desired outerly connected metallic fittings can be mounted on the connecting sections.

Figure 16:
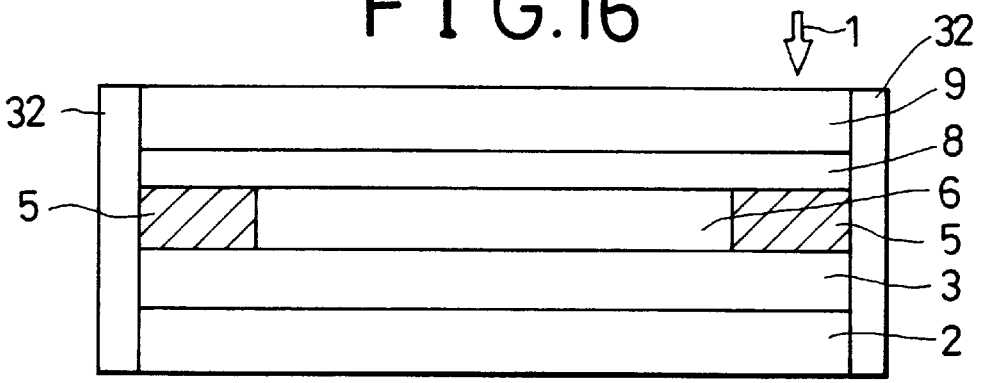
FIG. 16 is a transverse sectional view similar to FIG. 14 which illustrates a ninth preferred embodiment of a transparent heater panel of the present invention.

(j) Ninth Embodiment; FIG. 16

A transparent protective plastic film 9 is laminated via an adhesive layer 8 and the entire end faces of a heater panel are covered with a resin layer 32 containing an anticorrosive or organic protective layer. The heater panel has the same good anticorrosive effect as ever even when the resin layer 32 containing the anticorrosive is replaced by a transparent protective plastic member 7 without an anticorrosive as previously described using FIGS. 1 to 11.

Figure 17:
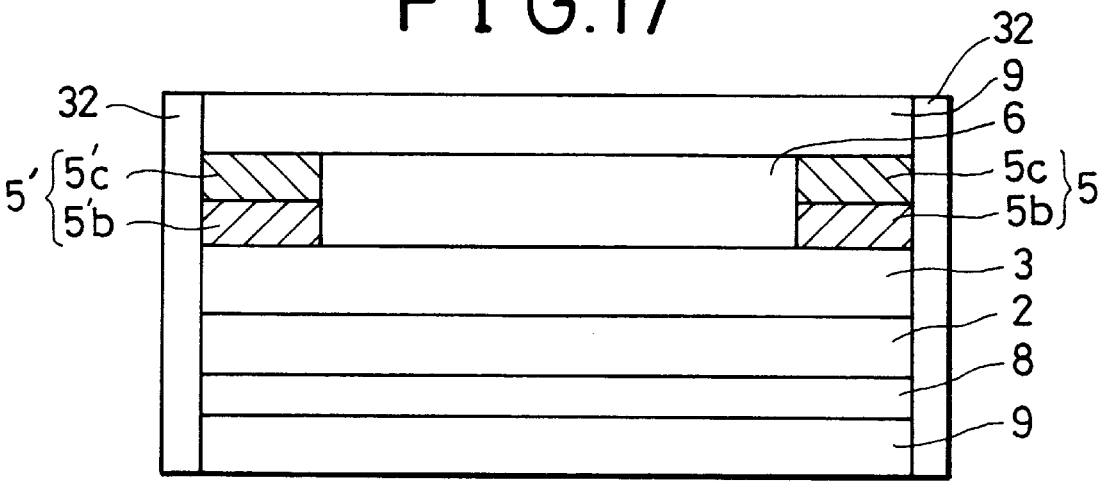
FIG. 17 is a transverse sectional view similar to FIG. 14 which illustrates a tenth preferred embodiment of a transparent heater panel of the present invention.

(k) Tenth Embodiment; FIG. 17

Electrodes 5 and 5' consist of conductive resin layers 5*b* and 5*b'* and plating layers 5*c* and 5*c',* respectively. A transparent protective plastic film 9 is also laminated, via an adhesive layer 8, on the lower surface of a transparent substrate 2, where a transparent conductive layer 3 is not to be formed. A resin layer 32 containing an anticorrosive may be replaced by a transparent protective plastic member 7 without an anticorrosive.

Figure 18:
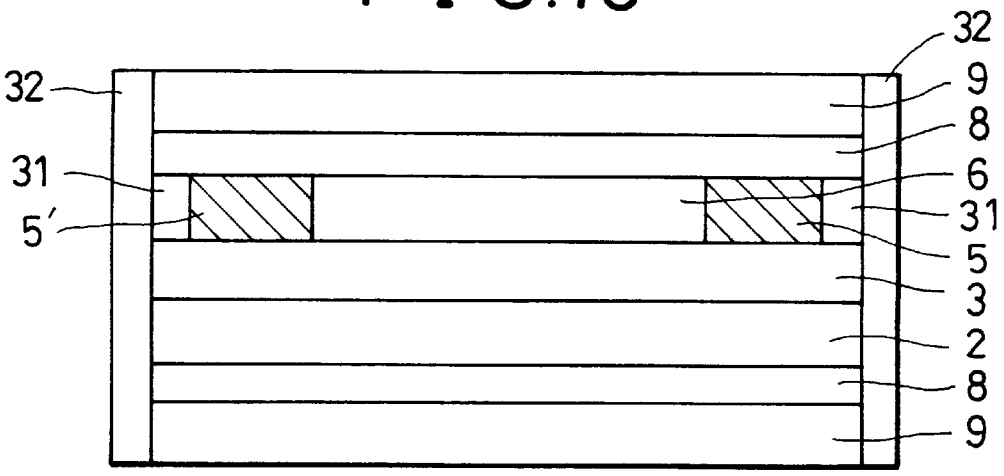
FIG. 18 is a transverse sectional view similar to FIG. 14 which illustrates an eleventh preferred embodiment of a transparent heater panel of the present invention.

(l) Eleventh Embodiment; FIG. 18

End faces of electrodes 5 and 5' are corrosion treated. That is, they are covered with an anticorrosive component layer 31. The entire end faces of a heater panel are covered with a resin layer 32 containing an anticorrosive. The resin layer 32 containing the anticorrosive may be replaced by a transparent protective plastic member 7 without an anticorrosive.

Preferred transparent heater panels of the present invention having a structure as illustrated in FIGS. 1 to 18 are improved especially in environmental durability and performance as a transparent heater panel and remarkably in reliability.

Preferred typical materials for portions which constitute a transparent heater panel of the present invention will be described.

A transparent substrate 2 is a substrate whose light transmission is generally 60% or more, preferably 70% or more, and more preferably 80% or more in a visible light range having a wavelength of from 400 nm to 800 nm. Glass plates and transparent plastic films can be used as the transparent substrate. The transmission of the plastic films does not exceed 95% unless anti-reflection treatment such as anti-reflection coating is carried out. Plastic films and sheets are preferably used from a viewpoint of thickness, flexibility, impact resistance or continuous productivity.

Preferred plastic films and sheets consist of polyesters such as polyethylene terephthalate and polyethylene naphthalate, or homopolymers or copolymers of polyamide, polyether, polysulfone, polyethersulfone, polycarbonate, polyarylate, polyether imide, polyether ether ketone, polyimide, aramid, poly(parabanic acid) or norbornene series polymers. A plastic film or sheet on which a moistureproofing layer or gas barrier layer is formed on one surface or both surfaces may also be used as the transparent substrate. The same materials as subsequently referred to about transparent protective plastic members 7 may also be suitably used as the moistureproofing layer or gas barrier layer.

An undercoat may be formed on the surface of a transparent substrate 2 to improve a heater panel in adhesiveness of the transparent substrate 2 to a transparent conductive layer 3. Crosslinkable resins or crosslinkable resins mounted on anchor agents are preferred as undercoats. Acrylepoxy resins, acrylsilicone resins, epoxy resins, acrylic resins, phenoxy ether crosslinkable resins, melamine resins, phenolic resins, urethane resins and UV-setting acrylates are preferably used as the crosslinkable resins. Water soluble polyurethane resins, water soluble polyamide resins, hydrophilic polyester resins, amorphous-polyethylene terephthalate (A-PET), ethylene-vinyl acetate emulsions and acrylic or methacrylic emulsions are preferably used as the anchor agents. Any of undercoats which can improve a heater panel in adhesiveness of a transparent substrate 2 to a transparent conductive layer 3 may be used. The undercoat's thickness is usually in the range of from 1 to 100 $\mu$m, preferably 10 to 50 $\mu$m. A layer of a substance, which consists of any of inorganic materials such as silicon oxide and magnesium fluoride and organic materials such as fluorine-containing resins and acrylic resins and which has a refractive index being less than 1.6, may be formed on the transparent substrate 2 as an anti-reflection layer having a thickness of from 0.1 nm to 200 $\mu$m.

Semiconductor thin layers, metallic thin layers and laminates of metallic thin layers and transparent thin layers can be applied to as the transparent conductive layer 3. The laminates may be multilayers. Laminates consisting of a transparent thin layer and a metallic thin layer having, as a main component, at least one selected from the group comprising silver and copper are particularly preferred.

Semiconductor thin layers constituting the transparent conductive layer 3 consist of indium oxide, tin oxide, ITO(indium tin oxide) or IZO(indium zinc oxide). The thin layers' thickness is generally in the range of from 10 to 1,000 nm, preferably 20 to 600 nm.

Transparent thin layers constituting the transparent conductive layer 3 are preferably single layers or laminates having at least two layers which are composed of any of materials selected from the group consisting of metallic oxides, metallic nitrides, metallic oxynitrides, metallic hydronitrides and metallic carbides.

Metallic thin layers constituting the transparent conductive layer 3 preferably comprise a first metallic thin layer (A) and a second metallic thin layer (B) which each are over transparent substrates in order of AB, BAB or BA;

the first metallic thin layer (A) being selected from the group consisting of (1) one of a lamina and a laminate comprising at least one metal selected from the group (a1) consisting of silver and copper;

(2) one of a lamina and a laminate comprising an alloy of at least one metal selected from the group (a1) and at least one metal selected from the group (a2) consisting of palladium, copper, platinum and gold; and (3) one of a lamina and a laminate consisting of a mixture of at least one metal selected from the group (a1) and at least one metal selected from the group (a2), the second metallic thin layer (B) being selected from the group consisting of (4) one of a lamina and a laminate comprising at least one metal selected from the group (b1) consisting of copper, nickel, tin, indium, titanium, palladium, aluminum, chromium, silicon, tungsten, vanadium, zinc, tantalum, gold, platinum and cobalt;

(5) one of a lamina and a laminate comprising an alloy of at least one metal selected from the group (b1); and (6) one of a lamina and a laminate of a mixture consisting of at least one metal selected from the group (b1).

The transparent conductive layer 3 is not limited to the above-mentioned examples. A metal such as silver, gold, copper, aluminum, nickel or chromium is used as a metallic thin layer constituting the transparent conductive layer 3. Silver, gold and copper are preferred. Particularly, (1) a metallic thin layer comprising a metal selected from the group consisting of silver and copper or an alloy thereof, and (2) a laminate of sandwiched structure which consists of a metallic thin layer (a) comprising a single metal selected from the group consisting of silver and copper or an alloy thereof and a transparent thin layer (b) comprising a compound selected from the group consisting of nitrides such as silicon nitride, metallic oxides such as indium oxide and titanium oxide, metallic carbides such as silicon carbide, especially a transparent thin layer of high refractive index, are preferably used as the transparent conductive layer 3. A laminate of a metallic thin layer and a transparent thin layer and a laminate whose metallic thin layer is sandwiched with transparent thin layers are preferred from a viewpoint of transparency or conductivity. A laminate consisting of a transparent thin layer containing at least one selected from the group consisting of nitrides, oxides and carbides and a substantially transparent metallic thin layer each is particularly preferred. A transparent thin layer of multilayer structure and a metallic thin layer of multilayer structure are also useful.

Metallic thin layers for the transparent conductive layer 3 having a transparent thin layer and a metallic thin layer in combination include a single layer and a laminate containing at least one substance selected from the group consisting of silver, an alloy containing silver and a mixture containing silver. The silver content of an alloy or a mixture containing silver is generally 5% by weight or more, preferably 30% by weight or more, more preferably 50% by weight or more, and most preferably 70% by weight or more. The copper content of an alloy or a mixture containing copper is generally 5% by weight or more, preferably 30% by weight or more, more preferably 50% by weight or more, and most preferably 70% by weight or more. In general, these contents do not exceed 99.9% by weight. The silver-copper content of an alloy or a mixture containing silver and copper is generally 5% by weight or more, preferably 30% by weight or more, more preferably 50% by weight or more, and most preferably 70% by weight or more. In general, the content does not exceed 99.9% by weight.

Metals such as gold, copper, palladium, platinum, and tungsten, titanium, cobalt, chromium, nickel, tin, indium, IT(indium-tin), silicon and zinc are preferred as metals for an alloy or a mixture containing silver from a viewpoint of preventing heater panels from deteriorating. The content of metals in a transparent conductive layer of a heater panel is sufficient if the heater panel is prevented from deteriorating. The metal content is generally from 2 to 60% by weight, preferably from 5 to 50% by weight, more preferably from 8 to 30% by weight.

The thickness of metallic thin layers is essentially from 1 to 500 nm, preferably from 5 to 50 nm, and more preferably from 10 to 30 nm.

For the purpose of improving a heater panel in adhesiveness of a silver thin layer or a metallic thin layer containing silver to a transparent thin layer, a metallic thin layer containing a metal other than silver is laminated on at least one surface of a silver thin layer or a thin layer containing silver as a main component (5% by weight or more of silver) to form a metallic thin layer used here. A single metal selected from the group consisting of nickel, chromium, titanium, gold, copper, platinum, tungsten, molybdenum, iridium, lead, tin, indium, zinc, palladium, cobalt, silicon, aluminum, germanium, manganese, gallium, tantalum, vanadium, zirconium, barium and niobium or an alloy or a mixture containing at least one selected from the abovementiond group are preferred as a metal other than silver which improves a metallic thin layer in adhesiveness to a transparent thin layer. The thickness of metallic thin layers containing a metal other than silver is generally from 0.1 to 50 nm, preferably from 0.3 to 30 nm, and more preferably from 0.5 to 10 nm, most preferably 0.5 to 5 nm.

Dielectric materials of high refractive index are preferred as transparent thin layers constituting the transparent conductive thin layer 3. The dielectric materials of high refractive index include nitride thin layers, oxide thin layers and carbide thin layers. Preferable materials constituting nitride thin layers include nitrides such as silicon nitride, aluminum nitride, indium nitride, gallium nitride, tin nitride, boron nitride, chromium nitride and silicon carbide nitride, oxynitrides such as silicon oxynitride, tin oxynitride, boron oxynitride, alluminum oxynitride, indium oxynitride, gallium oxynitride, chromium oxynitride and silicon carbide oxynitride, hydronitrides such as aluminum hydronitride, indium hydronitride, gallium hydronitride, silicon hydronitride, tin hydronitride, boron hydronitride, chrome hydronitride and silicon carbide hydronitride.

Nitrides, oxynitrides and hydronitrides each can be used. Transparent thin layers of high refractive index consisting of nitrides, oxynitrides or hydronitrides having a refractive index of generally 1.6 or more, preferably 1.8 or more, and more preferably 2.0 or more are preferred. In general, the refractive index does not exceed 3.0. The light transmission is generally 50% or more, preferably 70% or more, and more preferably 80% or more. In general, the light transmission does not exceed 98%.

The main components other than metals in the oxynitrides are oxygen and nitrogen. If nitrogen is present in the oxynitrides, in general, it is sufficient. The nitrogen content is generally 0.1 atom % or more, preferably 30 atom % or more, more preferably 50 atom % or more based on the sum of oxygen and nitrogen contents, and the upper limit is 99.9 atom %. The nitrogen content of the component other than metals in the hydronitrides is generally 50 atom % or more, and preferably 80 atom % or more. The thickness of the nitride layers is generally from 0.3 to 100 nm, preferably from 1 to 100 nm, more preferably 5 to 50 nm, and most preferably from 10 to 30 nm.

Materials for oxide thin layers constituting the transparent conductive layer 3 include indium oxide, tin oxide, indium tin oxide(ITO), indium zinc oxide(IZO), aluminum oxide, germanium oxide, silicon oxide, zinc oxide, zirconium oxide, titanium oxide, yttrium oxide, erbium oxide, cerium oxide, tantalum oxide and hafnium oxide. Oxides each can generally be used. Transparent thin layers of high refractive index consisting of oxides generally having a refractive index of 1.6 or more, preferably 1.8 or more, and more preferably 2.0 or more are preferred. The light transmission is generally 50% or more, preferably 70% or more, and more preferably 80% or more. In general, the light transmission does not exceed 98%. The thickness of at least one layer constituting the oxide thin layers is generally from 5 to 600 nm, preferably from 60 to 100 nm, and more preferably from 20 to 80 nm.

Each layer may be formed in the form of a mixture containing mutual components between layers constituting a transparent conductive layer or between a transparent conductive layer and a transparent substrate. When a new transparent conductive layer is formed on existing nitride and oxide layers, a portion or large portion of them may be changed into oxide and nitride layers, respectively.

Well-known methods such as a spray method, a coating method and a physical deposition method can be used as methods for forming metallic thin layers and transparent thin layers constituting the transparent conductive layers 3 on the transparent substrate 2. The physical deposition method is used for forming thin layers of metals under reduced pressure or under vacuum and includes a vacuum deposition method, a sputtering method, an ion plating method, an ion beam assisting deposition method, an ion cluster beam method, a molecular beam epitaxy (MBE) method, a chemical vapor deposition (CVD) method, an MOCVD method and a plasma CVD method.

In general liquid crystals, the temperature dependency of their movements is relatively small. If the temperature distribution in the surface of a transparent heater panel is in the range of about ±2° C., its movement is uniform. For example, in liquid crystals of ferroelectricity, the temperature dependency of their movements is large and the uniformity of temperature of about ±1° C. is desired. In installing such a transparent heater panel in a liquid crystal display, there is a temperature decrease in the peripheral end portions of the transparent heater panel due to the radiation of heat from the peripheral end portions thereof. To solve such a problem, patterning can be carried out on the surface of a transparent heater panel to remove part of its exothermic layer, form portions which do not generate heat, and make the temperature distribution of the heater panel uniform. The conventional etching technology can be used as a method for removing part of a transparent conductive layer or portions unnecessary to the generation of heat.

When protective layers usually have a light transmission of 50% or more, preferably 70% or more, and more preferably 80% or more at a wavelength of 550 nm and are proof against plating treatment, all of them may be used as the transparent protective layer 6. Materials of the transparent protective layer 6 include, for example, well-known UV-setting resist inks, electron beam-setting resist inks, thermosetting resist inks, UV-setting resins, electron beam-setting resins, layers formed by coating and curing thermosetting resins, and dry films. Moreover, transparent layers having waterproofing and chemical resistance can be used as the transparent protective layer 6. Transparent coating materials, thermosetting monomers or oligomers may be used to form the transparent protective layer 6. Plastic films such as polyester films coated with an adhesive, or self-adhesive films such as ethylene-vinyl acetate copolymer films may be laminated to form the layer 6. Layers formed by mixing or laminating these layers or films can also be used.

UV-setting resins used for the transparent protective layer 6 include epoxy acrylate, urethane acrylate, polyester acrylate, multifunctional acrylate, polyether acrylate, silicone acrylate, polybutadiene acrylate, unsaturated polyester-styrene, polyene-thiol, polystyryl methacrylate, and UV-setting lacquers.

Electron beam-setting resins include epoxy acrylate, urethane acrylate, polyester acrylate, multifunctional acrylate, polyether acrylate, silicone acrylate, polybutadiene acrylate, unsaturated polyester-styrene, polyene-thiol, polystyryl methacrylate, and UV-setting lacquers.

Thermosetting resins include epoxy resins, xylene resins, guanamine resins, diallyl phthalate resins, polyurethane, vinyl ester resins, unsaturated polyester, polyimide, melamine resins, maleic resins, urea resins and acrylic resins.

Fibrin derivative coating materials such as cellulose nitrate lacquers, acrylic lacquers and acetyl cellulose lacquers, alkyd resin coating, aminoalkyd resin coating, guanamine resin coating, vinyl chloride resin coating, butyral resin coating, styrene-butadiene resin coating, thermosetting acrylic resin coating, epoxy resin coating, unsaturated polyester coating, polyurethane resin coating and silicone resin coating are preferred as coating materials.

The thickness of the transparent protective layer 6 is generally from 1 to 100 $\mu$m, preferably from 5 to 50 $\mu$m, and more preferably from 10 to 30 $\mu$m. The transparent protective layer 6 may be formed on the surface of a transparent substrate 2 where no transparent conductive layer 3 is to be formed in order to improve a heater panel in light transmission or protect its transparent substrate 2.

Methods for forming the transparent protective layer 6 include well-known coating and laminating methods. Preferable methods include printing methods such as a screen method and coating methods such as a bar coating method, a spray coating method and a roll coating method. The transparent protective layer 6 also protects the transparent conductive layer 3. When the transparent protective layer 6 is formed before electrodes 5 are formed, it can perform its part in deciding positions reserved for the formation of the electrodes 5 and can particularly improve the preparation of a transparent heater panel in work efficiency.

Materials having conductivity each can be used as electrodes 5. Preferable electrodes include electrode layers consisting of a conductive resin alone, a conductive resin and a metallic foil in combination, a conductive resin and a plating layer in combination, and a plating layer alone.

Conductive resins used for the electrodes 5 include materials having conductivity alone such as polypyrrole and pastes such as silver paste, copper paste and silver-copper paste formed by mixing a resin with metallic powder such as silver powder or copper powder, or carbon such as carbon black alone or in combination. Metallic foils include copper foil and nickel foil. Plating metal layers include metallic layers such as nickel layer and copper layer which each can be formed by the conventional plating method. The layers can be used alone or in the form of a laminate or a mixed layer to form the electrodes 5. Conductive resin layers may be formed using the conventional printing method. In a metallic foil, an adhesive layer may be formed on one surface of the metallic foil so that the metallic foil adheres to a conductive resin layer and moreover, another conductive resin layer may be formed on the surface of the metallic foil which is not coated with an adhesive. Plating metal layers may be formed using a wet process such as an electroplating method, an electroless plating method or a direct plating method.

The electrodes 5 may have a thickness selected so that sufficient electric current is passed through the transparent conductive layer so that it can function as an exothermic surface. The thickness is generally 0.1 $\mu$m or more, preferably from 0.5 to 100 $\mu$m, more preferably from 1 to 50 $\mu$m, and most preferably from 5 to 20 $\mu$m.

When each of the electrodes 5 is formed using a plating process, its plating metal may reach any part of the transparent conductive layer 3 or the component of the transparent conductive layer 3 and the plating metal may be in a state of mixing. That is, when the transparent conductive layer 3 is a multilayer, the plating metal may reach at least one of a metallic oxide and nitride which are transparent thin layer components or may further penetrate to a metallic layer, and at least one of a metallic oxide and nitride which are transparent thin layer components under the metallic layer or a transparent substrate 2. A plating metal and a metallic component of at least one layer selected from the group consisting of a metallic oxide layer, a metallic nitride layer and a metallic layer may be in a state of mixing at least partially. When an electric current is passed from the electrodes 5 to the transparent conductive layer 3 and the transparent conductive layer 3 works as an exothermic surface, every type may be selected as one between the electrodes 5 and the transparent conductive layer 3.

Transparent protective plastic members 7 protect at least the end faces of the transparent conductive layer 3 from contaminants in order to prevent the transparent conductive layer 3 from corroding. Transparent protective plastic members functioning like this may be used freely. Transparent protective plastic members 7 which can protect the electrodes 5 and the transparent protective layer 6 mechanically and chemically in addition to the above-mentioned protection are preferred. Plastic members generally having a light transmission of 60% or more, preferably 70% or more, and more preferably 80% or more at a wavelength of 550 nm are used as the transparent protective plastic members 7. The transparent protective plastic members may be formed by laminating the same type of plastic film as a transparent substrate 2 with an adhesive or pressure sensitive adhesive, using the same type of plastic member as the transparent protective layer 6 or coating organic materials such as polyester, polyolefin and acrylic resin, and a silicone hard-coat agent. Silica sols functioning alike may be used in place of the organic materials.

Figure 2:
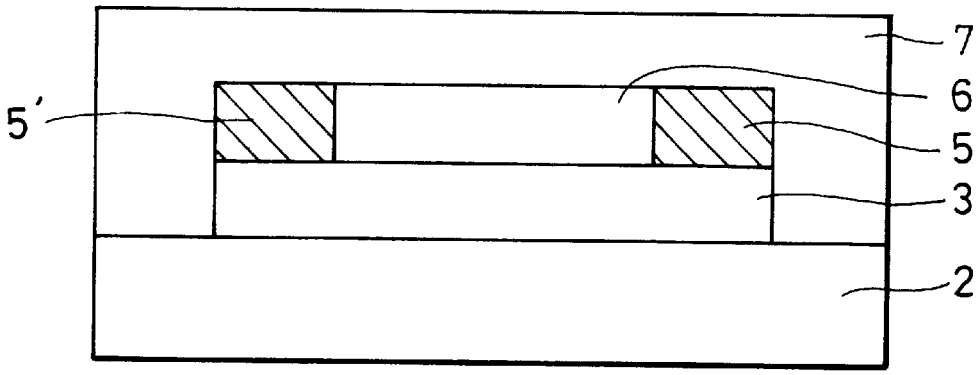
FIG. 2 is a transverse sectional view taken on line 2—2 of FIG. 1.

The transparent protective plastic member 7 may be formed by curing a material in a state of liquid or by laminating members in the form of a film or sheet. For example, it is formed over part of the end faces of a transparent heater panel or the entire end faces thereof including at least the end faces of a transparent conductive layer 3 using a liquid resin alone or a liquid resin which is formed by mixing with a solvent. A process for preparing the same consists of an operation of coating, spraying or dipping, and a curing operation under heating, drying or UV-irradiation condition. As another example, it is a preferred method to use a transparent plastic member with or without an adhesive under heating and pressure conditions for forming a transparent plastic member. A single layer or multilayer film or sheet, which consists of a material containing at least one type of material selected from the group consisting of the same materials as the previously illustrated materials for the transparent substrate 2 and the transparent protective layer 6, is suitably used. Transparent organic materials, which are selected from the group consisting of UV-setting liquid crystal sealing materials such as modified acrylate, thermosetting liquid crystal sealing materials such as epoxy sealing material and UV-setting combined with thermosetting liquid sealing materials consisting of mixtures thereof, sealing materials of epoxy resins, urethane resins, phenolic resins, silicone resins, silicone epoxy resins, or DPA epoxy resins; sealing materials for building resulting from polysulfide, acryl, acrylurethane, butyl rubber or SBR; coating or sealing materials for edge coating used for preventing mirrors from corroding in their peripheral portions; acrylic ester resins such as polymethylmethacrylate; acrylic resins such as polyacrylonitrile and polymethacrylonitrile; polyolefin resins such as polyethylene and polypropylene; silicone resins such as polymers resulting from ethyl silicate; polyester resins; melamine resins; fluorocarbon resins and phenolic resins may be applied to as the transparent protective plastic member 7. Several types of resins or materials selected from the above-mentioned compounds may be freely mixed or laminated for use according to the object. Transparent plastic members mixed or coated with anticorrosives as described below may be used as the transparent protective plastic member 7. The thickness of a portion of the transparent protective plastic member 7 with the portion covering at least the end faces of the transparent conductive layer 3 is generally from 0.5 to 200 $\mu$m, preferably from 1 to 50 $\mu$m, and more preferably from 5 to 30 $\mu$m. When the transparent protective plastic member 7 is in the form of a film or sheet and is laminated over the transparent protective layer 6 and the electrodes 5 and 5' as shown in FIG. 2, the thickness of the laminating portion is generally from 1 to 200 $\mu$m, preferably from 2 to 100 $\mu$m, more preferably from 5 to 50 $\mu$m. When another transparent protective plastic film 9 is laminated over the transparent protective plastic member 7 as shown in FIG. 5, the thickness of the transparent protective plastic film 9 is generally from 1 $\mu$m to 2 mm, preferably from 5 to 500 $\mu$m, more preferably from 10 to 200 $\mu$m, and most preferably from 50 to 150 $\mu$m. The same materials as the transparent protective plastic member 7 may be applied to as the transparent protective plastic film 9.

Plastic films whose moistureproofing or gas barrier layer are formed over one or both surfaces of their own may be used as the transparent protective plastic member 7. The moistureproofing or gas barrier layers are single layers or multilayer laminates consisting of thin layers comprising at least one compound selected from the group consisting of metallic oxides, metallic nitrides, metallic oxynitrides, metallic hydronitrides, metallic carbides and transparent polymers, which are illustrated as transparent thin layers constituting the transparent conductive layer 3. The multilayer laminates may be formed using the same type of single layers in combination.

Illustrative metallic oxides constituting the moistureproofing or gas barrier layers are silicon oxide layers formed by the decomposition of polysiloxanes or the chemical-plasma-deposition under the presence of oxygen of silane derivatives such as tetramethyldisiloxane and hexaethyldisiloxane. Metallic oxides formed by other materials or methods may be used as far as they have the same functions. The thickness of the metallic oxide layers, metallic nitride layers, metallic oxynitride layers, metallic hydronitride layers and metallic carbide layers each is generally from 0.3 to 500 nm, preferably from 1 to 100 nm, more preferably from 5 to 80 nm, and most preferably from 5 to 60 nm.

Illustrative transparent polymers constituting the moistureproofing or gas barrier layers include UV-setting resins, electron-beam setting resins and thermosetting resins. Particularly, at least one resin selected from the group consisting of urethane resins, epoxy resins, acrylic resins, acrylic ester resins, phenoxy ether crosslinkable resins, melamine resins, phenolic resins, silicone resins, xylene resins, guanamine resins, diallyl phthalate resins, vinyl ester resins, polyimide, maleic resins, unsaturated polyester resins and alkyd resins, and copolymers or mixtures thereof is preferred.

The UV-setting resins, electron-beam setting resins and thermosetting resins will be explained in detail asfollows.

Epoxy acrylate, urethane acrylate, polyester acrylate, multifunctional acrylate, polyether acrylate, silicone acrylate, polybutadiene acrylate, unsaturated polyester-styrene, polyene-thiol, polystyrylmethacrylate and UV-setting lacquers, and copolymers or mixtures thereof are suitably used as the UV-setting resins. Epoxy acrylate, urethane acrylate, polyester acrylate, multifunctional acrylate, polyether acrylate, silicone acrylate, polybutadiene acrylate, unsaturated polyester-styrene, polyene-thiol, polystyrylmethacrylate and UV-setting lacquers, and copolymers or mixtures thereof are suitably used as the electron-beam setting resins. Epoxy resins, xylene resins, guanamine resins, diallyl phthalate resins, polyurethane, vinyl ester resins, unsaturated polyester, polyimide, melamine resins, maleic resins, urea resins, acrylic resins, silicone resins and alkyd resins, and copolymers or mixtures thereof are suitably used as the thermosetting resins.

Polyolefins such as polypropylene, polyethylene and ethylene-propylene copolymers, polyesters, polyamides, ionomer, polyvinylacetate, ethylene-vinyl acetate copolymers, acrylic resins such as acrylate and methacrylate, polyvinylacetal, phenolic resins and modified epoxy resins, and copolymers or mixtures thereof may be used in order to improve the transparent polymers in moistureproofing property. Mixtures consisting of thermosetting resins and UV-setting resins may be used as the setting resin and mixtures having different types of resins may be used.

Polymers, gas permeability resistance resins, containing 60% by mole or more of at least one component selected from the group consisting of acrylonitrile component, vinyl alcohol component, vinyl butyral component, cellulose component, aramiel component, halogenated vinyl component and halogenated vinylidene component or mixtures thereof may be used in order to improve the transparent polymers in gas barrier property. Illustrative polymers of the acrylonitrile component include polyacrylonitrile and acrylonitrilebutadiene copolymers. Illustrative polymers of the vinyl alcohol component include polyvinylalcohol. Illustrative polymers of the vinyl butyral component include polyvinylbutyral and mixtures of polyvinylbutyral and epoxy resins. Illustrative polymers of the halogenated vinylidene component include polyvinylidene chloride (PVDC), PVDC-VC copolymers, PVDC-acrylonitrile copolymers, PVDC-acrylate copolymers, multicopolymers containing several types of monomers copolymerizable with vinylidene chloride and polytetrafluoroethylene (PTFE). Illustrative polymers of the halogenated vinyl component include trifluoromonochloroethylene.

Anchor coat layers may be formed on the transparent substrate 2 before the transparent substrate 2 is coated with gas permeability resistance resins to improve the transparent polymers in gas barrier property. Preferable anchor coat materials for the transparent polymers include at least one resin selected from the group consisting of polyurethane, polyamide, polyethyleneimine, amorphous polyester, hydrophilic polyester, ion polymer complexes and alkyl titanate resins, and copolymers or mixtures thereof.

The thickness of the anchor coat layers, the setting resin layers, the gas permeability resistance resin layers and the thermoplastic resin layers is generally from 0.5 to 200 $\mu$m, preferably from 1 to 50 $\mu$m, and more preferably from 5 to 30 $\mu$m.

Well-known transparent pressure sensitive adhesives and transparent adhesives may be used when plastic films or sheets are used as the transparent protective plastic member 7. Preferable adhesives include acrylic pressure adhesives and cyanoacrylic reactive adhesives. When a transparent protective plastic film with an adhesive is used as the transparent protective plastic film and can be joined to the transparent substrate 2 at an intended force, each type is available. When the adhesive is opaque, it may be used in positions other than exothermic portions. The adhesives will be describe d below.

Pressure sensitive adhesives;

acrylic type

Solvent-type adhesives:

vinyl acetate resins, chloroprene rubber, nitrile rubber, cellulose or multiliquid mixing type Emulsion-type adhesives:

α-olefin, setting vinyl acetate resin, vinyl acetate resin, vinyl acetate-acrylic, acrylic copolymer, vinyl-urethane, epoxy, vinylidene chloride, vinyl chloride, nonaqueous emulsion, powder emulsion or synthetic rubber latex type Chemical reaction-type adhesives:

cyanoacrylate, epoxy or polyurethane resin type

Hot melt-type adhesives:

EVA, polyamide or polyester type

Adhesives resulting from urea resins, melamine resins, phenolic resins, resorcinol resins, α-olefin resins, epoxy resins, polyurethane, acrylic resins, methacrylic resins, or derivative resins and copolymers thereof may be used. UV-setting adhesives, electronbeam setting adhesives and thermosetting adhesives may be used.

In some cases, coupling agents such as silane coupling agents may be applied to the transparent substrate 2 and the transparent protective plastic member 7 in order to improve the adhesion force between them. Illustrative silane coupling agents include vinyltrichlorosilane, vinylethoxysilane, vinyl-tris-(β-methoxyethoxy)silane, γ-methacryloxypropyltrimethoxysilane, β-(3,4-epoxycyclohexyl)ethyltrimethoxysilane, γ-glycidoxypropyltrimethoxysilane, γ-aminopropyltriethoxysilane, N-β-(aminoethyl)-γ-aminopropyltrimethoxysilane, N-(dimethoxymethylsilylpropyl)ethylenediamine and N-(trimethoxysilylpropyl)-ethylenediamine.

When anticorrosive treatment with anticorrosives is carried out as previously described according to FIGS. 14 to 18, the anticorrosives include the following.

(1) at least one effective component selected from the group consisting of benzotriazole, indazoles, imidazoles and derivatives thereof;

(2) at least one effective component selected from the group consisting of amino acids, esters of amino acids, alkali metal salts of amino acids, ammonia and salts of amines;

(3) one effective component selected from the group consisting of mercaptan and derivatives of mercaptan which are closely related to mercaptan;

(4) one effective component comprising any of copper chelate compounds;

(5) a mixture comprising at least two of effective components (1) to (4); and (6) a mixture comprising at least one of effective components (1) to (4) and a third component.

When copper is used as the material of the electrodes 5, particularly the use of amino acids alone, benzotriazoles alone, or amino acids and benzotriazoles in combination is effective in preventing the electrodes from corroding in their end faces.

Benzotriazoles used for anticorrosion treatment include 1,2,3-benzotriazole and its derivatives. The derivatives include 2-alkylated benzotriazoles such as 2-methylbenzotriazole, 2-phenylbenzotriazole, 5,6-methylbenzotriazole, 5-benzotriazole carboxylic acid, halogenated benzotriazole, hydroxybenzotriazole, dodecylbenzotriazole, carboxybenzotriazole, esters of carboxybenzotriazole such as esters or soluble salts having methyl, ethyl, isopropyl, butyl, hexyl, octyl or dodecyl group.

Indazoles used for corrosion treatment include 4-chloroindazole, 4-nitroindazole, 4-chloro-5-nitroindazole, 5-nitro-3-methylindazole, 4,6-dinitro-5,7-dimethylindazole and 5,7-dinitro-6-methylindazole.

Imidazoles used for corrosion treatment include alkylated imidazoles such as 2-octylimidazole, 2-undecylimidazole and 2-heptanedecylimidazole; and imidazole, nitroimidazole, oxyimidazole, benzoimidazole, N-acetylimidazole and N-benzoylimidazole.

Amino acids used for anticorrosion treatment include neutral amino acids, basic amino acids, acidic amino acids, sulfur containing amino acids, aromatic amino acids and ring amino acids having different knots, which can be reacted with copper or metals of the copper group to form complexes. Preferable examples of amino acids include glycine, alanine, valine, leucine, isoleucine, serine, arginine, glutamine, glutamic acid, aspartic acid, cysteine, methionine, phenylalanine, histidine, oxyproline and hydroxy protein and esters thereof. Particularly amino acids being more hydrophilic are preferred. Preferable alcoholic components of the esters have a carbon number of 8 or less. Saturated or unsaturated hydrocarbon groups may be selected and include methyl, ethyl, propyl, benzyl, amyl and octyl.

Mercaptans used for anticorrosion treatment include molecules which are derived from mercaptan and closely related to mercaptan such as disulfides and thiol esters. For example, they include mercaptoacetic acid, 3-mercaptopropionic acid, 1-mercaptoundecyl acid, thiophenol, phenyldisulfide, N-(2-hydroxymethyl) mercaptoacetoamide, 2,2'-dimercaptodiethylether, 2,2'-dimercaptodiethylthioether, 1,2-ethanedithiol, 3-mercaptopropyltrimethoxysilane, glycolbis(3-mercaptopropionate), trimethylolpropanetris(3-mercaptopropionate) and glycoldimercaptoacetate.

Copper chelate compounds used for anticorrosion treatment are mainly organic copper chelate compounds and include copper acetylacetate, copper trifluoroacetylacetate, copper ethylenediamine, copper phthalocyanine, hemocyanin, copper ethylenediaminetetraacetate, copper dimethyldithiocarbamate and copper hydroxyquinoline. Copper salts of organic acids such as copper citrate, copper tartrate, copper lactate and copper acetate may be used equally.

When an organic protective layer 32 containing an anticorrosive is formed over at least the end faces of the transparent conductive layer 3 for the purpose of anticorrosion (FIG. 16 and others), the same materials as the previously illustrated materials for the transparent protective plastic member 7 may suitably be used as organic compounds of the organic protective layer 32. The same materials as the previously illustrated materials for the transparent substrate 2 and the transparent protective layer 6 may be suitably used for the purpose. When resin layers, coating materials or sealing materials are used as the organic protective layer 32 containing the anticorrosive, the thickness thereof is not limited in particular but is generally from 1 to 1,000 $\mu$m, preferably from 5 to 500 $\mu$m, and more preferably from 10 to 200 $\mu$m.

When an adhesive layer containing an anticorrosive is formed on at least the end faces of the transparent conductive layer 3 for the purpose of anticorrosion, the adhesive includes the above-mentioned adhesives used for joining the transparent protective plastic member 7 to the transparent substrate 2.

When the end faces of the transparent conductive layer 3 is treated with an anticorrosive to form an anticorrosive component layer 31 (FIG. 14 and others), well-known methods may be used freely in order to add the effective component. The methods include a coating method in which anticorrosives soluble in suitable solvents such as benzotriazoles, indazoles, imidazoles, amino acids, mercaptans and copper chelates are coated on at least part of the end faces of transparent heater panels or the entire end faces thereof including at least the end faces of the transparent conductive layer 3, a spray method in which anticorrosives are sprayed with a spray gun and a dipping method in which the end faces of the transparent heater panels are dipped into such solvents.

In compounds whose anticorrosive components have sublimation property, when the end faces of a transparent heater panel are exposed to the compounds heated at a suitable temperature in order to attain treatment, the object of the present invention may be achieved. The state that the anticorrosive component is in contact with the end faces thereof or penetrates into the transparent conductive layer 3 is called inclusion. As a result, the objects of the present invention may sufficiently be achieved.

Each anticorrosive component is mixed with a resin component with or without a solvent to form an organic protective layer 32 containing an anticorrosive. A process for preparing the same consists of an operation of coating, spraying or dipping and a curing operation under heating, drying or UV-irradiation condition. Otherwise, a polymer film or sheet with an adhesive layer containing an anticorrosive component may be applied to at least part of the end faces of a transparent heater panel or the whole end faces thereof including at least the end faces of the transparent conductive layer 3 to form the resulting adhesive layer containing the anticorrosive component on condition that the adhesive layer is in contact with the end faces thereof.

The concentration of the anticorrosive component is preferred to be as high as possible from a viewpoint of anticorrosive function. However, when an organic protective layer or adhesive layer contains an anticorrosive, the concentration of the anticorrosive based on the solid content including a resin component is generally 20% by weight or less, and preferably 10% by weight or less. When the end faces are directly anticorrosion treated with an anticorrosive dissolved in a solvent, the concentration based on the entire solution is generally 5% by weight or less, and preferably 3% by weight or less.

In the above-mentioned anticorrosive treatment with the transparent protective plastic member 7 or the anticorrosive, the end faces including at least the cut end faces of the transparent conductive layer 3 is treated. When the transparent conductive layer 3, in particular, contains a metallic thin layer having at least one of silver and copper as a main component, anticorrosion treatment of at least the end faces of the metallic thin layer is preferred. The end faces of the transparent heater panel or the peripheral end faces of the transparent heater panel other than the end faces of the metallic thin layer may be anticorrosion treated. A preferable embodiment is anticorrosion treatment of the end faces of the electrodes 5 and the transparent protective layer 6. Examples of portions which are anticorrosion treated among the end faces of the transparent heater panel of the present invention include (1) part of the end faces of a transparent conductive layer 3, (2) the whole end faces of a transparent conductive layer 3, (3) part of the peripheral end faces of a transparent heater panel, (4) the whole peripheral end faces of a transparent heater panel, (5) part of the end faces of a transparent conductive layer 3 and part of the peripheral end faces of a transparent heater panel and (6) the whole end faces of a transparent conductive layer 3 and the whole peripheral end faces of a transparent heater panel.

More concrete examples of materials which are anticorrosion treated include (1) a metallic thin layer constituting a transparent conductive layer 3, (2) a laminate consisting of a transparent thin layer and a metallic thin layer constituting a transparent conductive layer 3, (3) a transparent thin layer, a metallic thin layer and a transparent thin layer constituting a transparent conductive layer 3, (4) a transparent protective layer 6, a transparent thin layer, a metallic thin layer and a transparent thin layer constituting a transparent conductive layer 3 and a transparent substrate 2, (5) a transparent protective plastic film 9, an adhesive layer, a transparent protective layer 6, a transparent thin layer, a metallic thin layer and a transparent thin layer constituting a transparent conductive layer 3, a transparent substrate 2, an adhesive layer and a separator 11. A transparent conductive layer 3 in which several metallic thin layers and transparent thin layers are laminated may be corrosion treated.

Figure 3A:
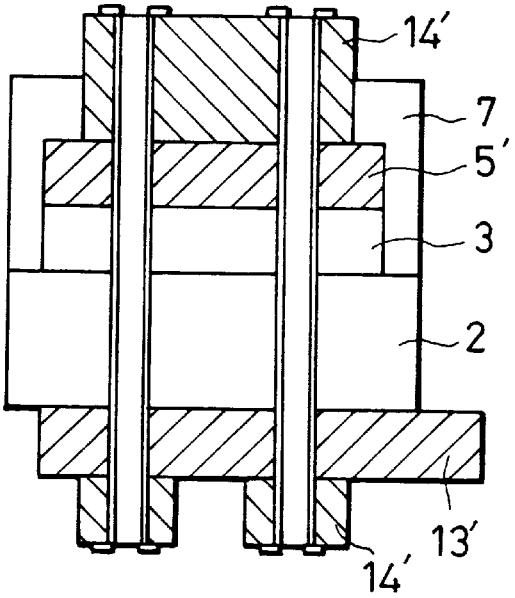
FIGS. 3 (*a*),(*b*) are transverse sectional views taken on lines 3*a*—3*a*, 3*b*—3*b* of FIG. 1.
Figure 3B:
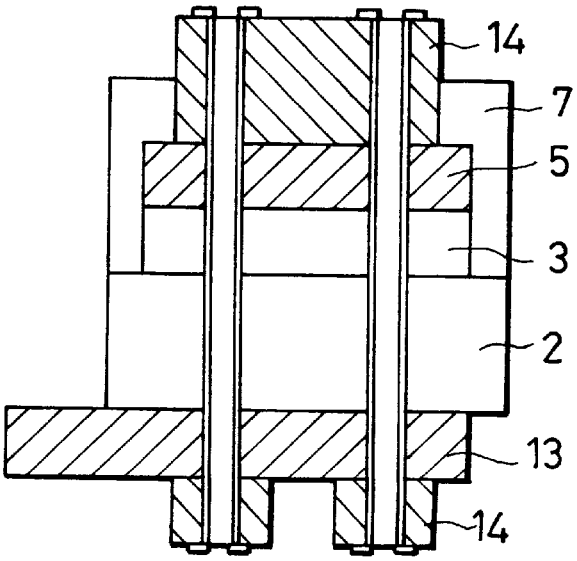
Figure 4:
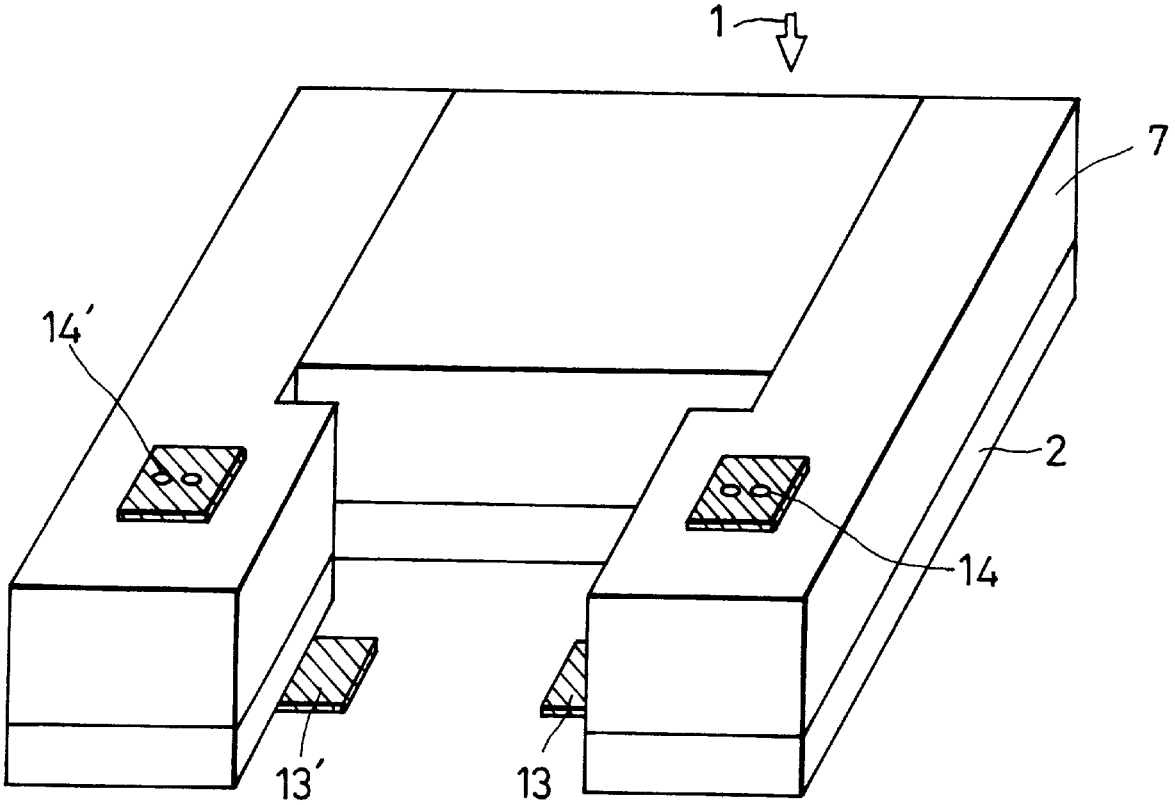
FIG. 4 is a perspective view of the heater panel of FIG. 1.

When a metal tab 13 is mounted with an eyelet 14 on the electrode 5 of the transparent heater panel 1 and an electric wire is soldered onto the metal tab for use, the metal tab 13 may be mounted anywhere on the electrode 5 and is preferably mounted on the connecting section 5*a* of the electrode 5. The metal tab 13 may be not only mounted on the electrode 5 of the transparent heater panel 1 but also on the transparent substrate 2 on the opposite side of the metallic electrode in order to physically fix to the transparent heater panel of the present invention with the eyelet 14 and electrically connect with the electrode 5 (FIG. 3 and others).

The metal tab 13 may be mounted on both surfaces, the surfaces of the electrode 5 of the transparent heater panel and the transparent substrate 2 on the opposite side of the electrode 5, in order to electrically connect with the electrode 5, followed by mechanical stabilaization of the metal tab 13. It may be mounted on an adhesive layer or separator 11 in order to electrically connect with the electrode 5. Materials consisting of parts functioning as the eyelet 14 and metal tabs 13 in combination may be used. An electric power may be supplied with alligator clips on condition that no metal fittings 13 for connecting with outer electrodes are mounted on the electric portions.

When the transparent heater panel is joined to a support structure, an adhesive layer may be formed on the surface of the transparent substrate 2 or the transparent protective plastic member 7. When the transparent protective plastic member 7 is not formed on the main surface of the transparent heater panel, an adhesive layer may be formed on part or the whole of surfaces of the transparent protective layer 6 and the electrodes 5, which are optionally selected. Well-known transparent pressure sensitive adhesives and adhesives may be used for the adhesive layer. Preferable examples include acrylic pressure sensitive adhesives and cyanoacrylate reactive adhesives. The transparent heater panel may be coated with the adhesive directly before its use and joined under pressure condition to a support structure such as a liquid crystal display in order to fix the transparent heater panel itself. When an adhesive layer is formed on the transparent heater panel in advance, a separator 11, or a release sheet, is preferred to be optionally laminated on the surface of the adhesive layer (FIG. 6 and others) in order to prevent an object from adhering to the surface of the adhesive layer in sending and keeping the resulting product. The separator 11 includes common release paper, polyethylene film, polypropylene film or polyester film. The thickness of the separator is generally from 1 to 200 $\mu$m, preferably from 2 to 100 $\mu$m, and more preferably from 5 to 50 $\mu$m.

A process for preparing corrosion-proof transparent heater panels of the present invention will be described. The process is characteristic of a step of anticorrosion treating the end faces of a transparent conductive layer and the peripheral end faces of a transparent heater panel to prepare the above-mentioned transparent heater panel of the present invention. Typical examples of the preparation process are as follows.

A first embodiment is a process for preparing a transparent heater panel which comprises (1) a first step of forming a transparent protective layer over a portion of a transparent conductive layer which is formed on a first surface of a transparent substrate and which functions as an exothermic surface;

(2) a second step of forming a resist over a portion of the transparent conductive layer which is to be covered with a transparent protective plastic member;

(3) a third step of forming a first electrode and a second electrode;

(4) a fourth step of removing the resist;

(5) a fifth step of removing a surplus of the transparent conductive layer;

(6) a sixth step of covering each of the end faces of the transparent conductive layer and each of the peripheral end faces of the transparent heater panel with the transparent protective plastic member; and (7) a seventh step of removing a surplus of the transparent heater panel.

A second embodiment is a process for preparing a transparent heater panel according to the first embodiment which further comprises (1) a first step of preparing in advance a transparent heater panel which is not covered with a transparent protective plastic member; and (2) a second step of covering each of the end faces of the transparent conductive layer, each of the peripheral end faces of the transparent heater panel and the first and second surfaces of the transparent heater panel with a transparent protective plastic member.

Suitable embodiments for preparing corrosion-proof transparent heater panels of the present invention will be described.

(1) Portions of a transparent conductive layer 3 other than portions covered by a transparent protective layer 6 and electrodes 5 are removed by etching from the transparent conductive layer 3 formed on a transparent substrate 2 to produce an original film of a transparent heater panel. The transparent heater panel is obtained from the original film of the transparent heater panel according to the methods from (1.1) to (1.6) described below.

(1.1) A transparent protective plastic member 7 is formed on the whole surface of the transparent protective layer 6 of the original film. The transparent substrate 2 is cut off in a junction from which part of the transparent conductive layer 3 is removed and which is covered by the transparent protective plastic member 7 to produce an intermediate transparent heater panel with the end faces of the transparent conductive layer 3 and the peripheral end faces of the transparent heater panel covered by the transparent protective plastic member 7. Metal tabs 13 which are to be connected with outer electrodes are mounted on the thus-obtained intermediate transparent heater panel's electrode portions with eyelets 14 to obtain the transparent heater panel.

(1.2) A transparent protective plastic member 7 is formed on the surface of the original film except for portions of the electrodes 5 which correspond to connecting sections connected with outer electrodes. The transparent substrate 2 is cut off in the same way as the above-mentioned way (1.1) to obtain an intermediate transparent heater panel. Metal tabs 13 which are to be connected with outer electrodes are mounted with eyelets 14 on the thus-obtained transparent heater panel's electrode portions not covered by the transparent protective plastic member 7 to obtain the transparent heater panel.

(1.3) A transparent protective plastic member 7 is superposed on the transparent conductive layer 3 of the original film and joined to the transparent substrate 2 under heating and pressure conditions in a portion of the transparent substrate 2 from which the transparent conductive layer 3 is removed. The transparent substrate 2 is cut off in a junction from which part of the transparent conductive layer 3 is removed and which is covered by the transparent protective plastic member 7 to produce an intermediate transparent heater panel with at least the end faces of the transparent conductive layer 3 and the peripheral end faces of the transparent heater panel covered by the transparent protective plastic member 7. Metal tabs 13 which are to be connected with outer electrodes are mounted with eyelets 14 on the thus-obtained intermediate transparent heater panel's electrode portions covered by the transparent protective plastic film 7 to obtain the transparent heater panel.

(1.4) A transparent protective plastic member 7 having a hole in a portion which corresponds to a connecting section connected with an outer electrode and which is over a portion of the electrode is superposed on the transparent conductive layer 3 of the original film on condition that the hole is superposed on the portion of the electrode. It is joined under heating and pressure conditions to the transparent substrate 2 in a junction from which part of the transparent conductive layer 3 is removed. The transparent substrate 2 is cut from the original film in the same way as the above-mentioned way (1.3) to obtain an intermediate transparent heater panel with at least the end faces of the transparent conductive layer 3 and the peripheral end faces of the transparent heater panel covered by the transparent protective plastic film 7. Metal tabs 13 which are to be connected with outer electrodes are mounted with eyelets 14 on the thus-obtained transparent heater panel's electrode portions not covered by the transparent protective plastic member 7 to obtain the transparent heater panel.

(1.5) A transparent protective plastic member 7 with an adhesive layer or a pressure sensitive adhesive layer is superposed on the transparent conductive layer 3 of the original film of the transparent heater panel. The transparent substrate 2 is cut from the original film in the same way as the above-mentioned way (1.3) to obtain an intermediate transparent heater panel with at least the end faces of the transparent conductive layer 3 and the peripheral end faces of the transparent heater panel covered by the transparent protective plastic film 7. Metal tabs 13 which are to be connected with outer electrodes are mounted with eyelets 14 on the thus-obtained intermediate transparent heater panel's electrode portions covered by the adhesive layer or the pressure sensitive adhesive layer to obtain the transparent heater panel.

(1.6) A transparent protective plastic member 7 with an adhesive layer or a pressure sensitive adhesive layer having a hole in a portion which corresponds to a connecting section connected with an outer electrode and which is over a portion of the electrode is superposed on the transparent conductive layer 3 of the original film and joined to the same on condition that the hole is superposed on the portion of the electrode. The transparent substrate 2 is cut from the original film in the same way as the above-mentioned way (1.3) to obtain an intermediate transparent heater panel with at least the end faces of the transparent conductive layer 3 and the peripheral end faces of the transparent heater panel covered by the transparent protective plastic film 7. Metal tabs 13 which are to be connected with outer electrodes are mounted with eyelets 14 on the thus-obtained intermediate transparent heater panel's electrode portions not covered by the transparent protective plastic film with the adhesive layer or the pressure sensitive adhesive layer to obtain the transparent heater panel. A second transparent protective plastic film without an adhesive layer may be laminated on at least the transparent protective plastic film 7 and a third transparent protective plastic member 7 with an adhesive layer may be laminated.

(2) A surplus of a laminate having an exothermic surface with a transparent protective layer 6 and electrodes formed on a transparent conductive layer 3 is cut from the laminate to produce an original film of transparent heater panels. Each transparent heater panel is obtained from the original film according to any of the methods from (2.1) to (2.4) described below.

(2.1) A transparent protective plastic member 7 is superposed on the transparent conductive layer 3 of the original film and another transparent protective plastic member 7 is superposed on the surface opposite from the transparent conductive layer 3. The two transparent protective plastic members are joined together under heating and pressure conditions in edge portions of the original film to produce an intermediate transparent heater panel covered by the transparent protective plastic member 7. Metal tabs 13 for connecting with outer electrodes are mounted with eyelets 14 on the intermediate transparent heater panel's electrode portions not covered by the transparent protective plastic member 7 to produce the transparent heater panel.

(2.2) A transparent protective plastic member 7 having a hole in a portion which corresponds to a connecting section connected with an outer electrode and which is over an electrode portion is superposed on the transparent conductive layer 3 of the original film on condition that the hole is superposed on the electrode portion. Another transparent protective plastic member without a hole is superposed on the surface opposite from the transparent conductive layer 3. The two transparent protective plastic members are joined together under heating and pressure conditions in edge portions of the original film to produce an intermediate transparent heater panel covered by the transparent protective plastic member 7. Metal tabs 13 for connecting with outer electrodes are mounted with eyelets 14 on the intermediate transparent heater panel's electrode portions not covered by the transparent protective plastic member 7 to produce the transparent heater panel.

(2.3) A transparent protective plastic member 7 with an adhesive layer or a pressure sensitive adhesive layer is superposed on the transparent conductive layer 3 of the original film. Another transparent protective plastic member is superposed on the surface of the original film opposite from the transparent conductive layer 3. The two transparent protective plastic members are joined together under pressure condition in the whole surface or edge portions of the original film to produce an intermediate transparent heater panel covered by the transparent protective plastic member 7. A third transparent protective plastic member 7 with an adhesive layer or a pressure sensitive adhesive layer may be superposed on the surface of the original film opposite from the transparent conductive layer 3. Metal tabs 13 for connecting with outer electrodes are mounted with eyelets 14 on the intermediate transparent heater panel's electrode portions not covered by the transparent protective plastic member 7 to produce the transparent heater panel.

(2.4) A transparent protective plastic member 7 with an adhesive layer or a pressure sensitive adhesive layer having a hole in a portion which corresponds to a connecting section connected with an outer electrode and which is over an electrode portion is superposed on the transparent conductive layer 3 of the original film and another transparent protective plastic member without a hole is superposed on the surface of the original film opposite from the transparent conductive layer 3 on condition that the hole is superposed on the electrode portion. The two transparent protective plastic members are joined together under pressure condition to produce an intermediate transparent heater panel covered by the transparent protective plastic member 7. A transparent protective plastic film with an adhesive layer or a pressure sensitive adhesive layer may be laminated on the surface of the original film opposite from the transparent conductive layer 3. Metal tabs 13 for connecting with outer electrodes are mounted with eyelets 14 on the intermediate transparent heater panel's electrode portions not covered by the transparent protective plastic member 7 to produce the transparent heater panel.

However, there is no limit to the preparation process of the present invention. A transparent protective plastic film in the form of a bag or with an adhesive layer may be used as the member 7. A method of covering a luminous surface depending on electroluminescence (EL) with a moisture proofing film to protect may be used. Various types of methods, which are different from this type and in which a transparent conductive layer 3 is protected with a transparent plastic film alone or a transparent plastic film having one of adhesive layers and pressure sensitive adhesive layers, may be used. Moreover, even if an extra portion of the transparent conductive layer 3 is not removed and stays behind in the range of the preparation process of the present invention, the extra portion of the transparent conductive layer may stay behind if the transparent conductive layer is prevented from corroding in its end faces and peripheral end faces owing to hygroscopic moisture.

A preferable embodiment of a process for preparing corrosion-proof transparent heater panels of the present invention will be described in detail according to FIGS. 19 to 26.

Figure 19A:
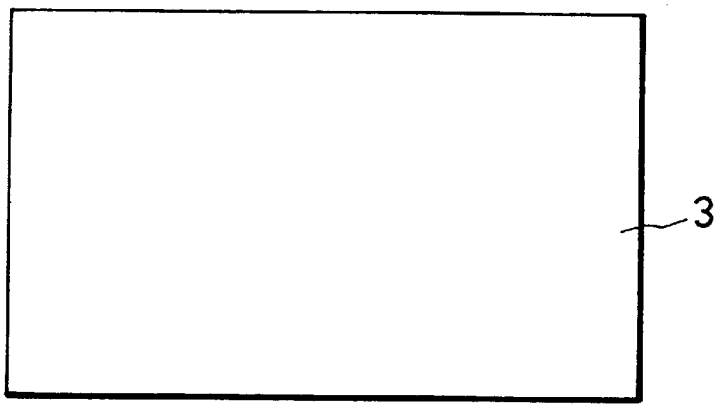
In FIGS. 19 to 26, part (*a*) is a plan view and part (*b*) is a sectional view illustrating a series of preferred preparation units in which corrosion-proof transparent heater panels are prepared.
Figure 19B:
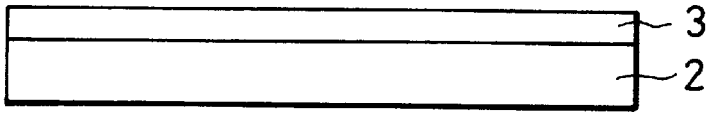
Figure 20A:
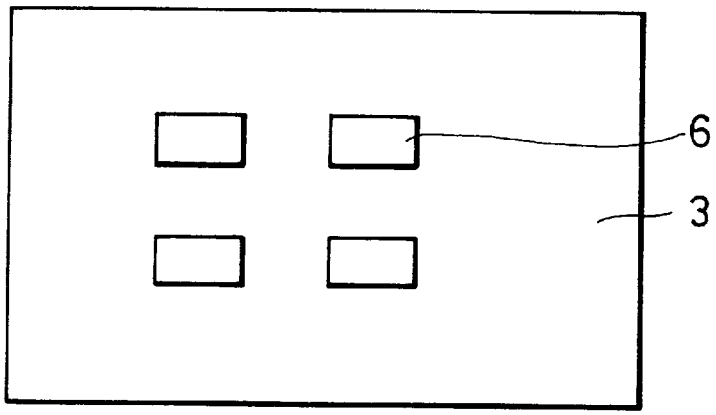
Figure 20B:
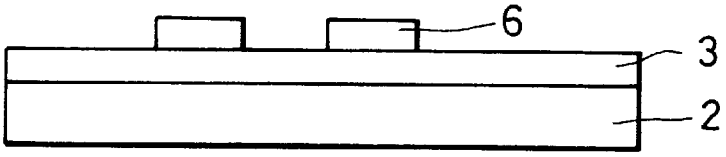

As shown in FIG. 19, a transparent conductive layer 3 is formed on a surface of a transparent substrate 2 to make a transparent conductive substrate. As shown in FIG. 20, transparent protective layers 6 are formed by printing on condition that each transparent protective layer can form a surface pattern which corresponds to an exothermic surface of the transparent conductive layer 3. The surface pattern which corresponds to the exothermic surface is a portion where the transparent conductive layer 3 between electrodes 5 and 5', which are opposite from each other and which are formed according to a following step, generates heat. It includes portions except (1) a portion reserved for the connection of the transparent substrate 2 with a transparent protective plastic member 7 formed according to a following step, (2) portions reserved for the formation of the electrodes 5 and 5' according to a following step and (3) other portions such as electrode portions for plating.

Figure 21A:
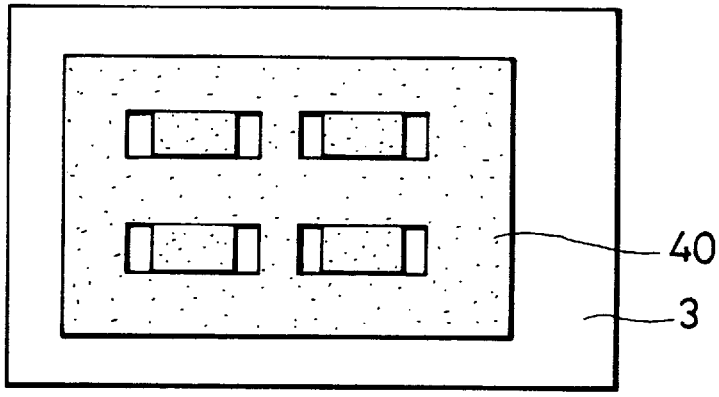
Figure 21B:
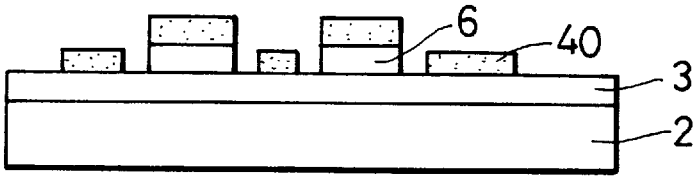
Figure 22A:
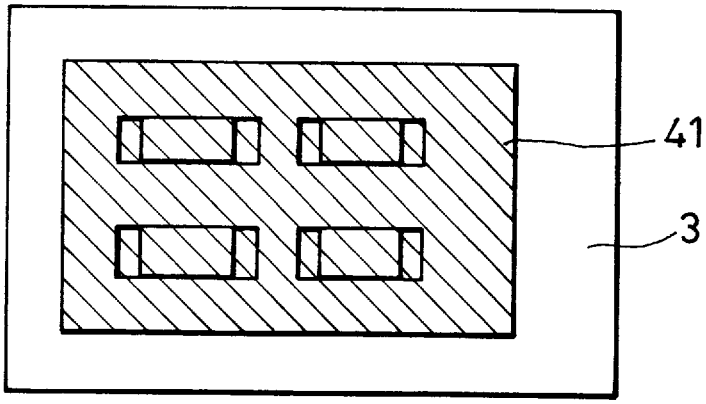
Figure 22B:
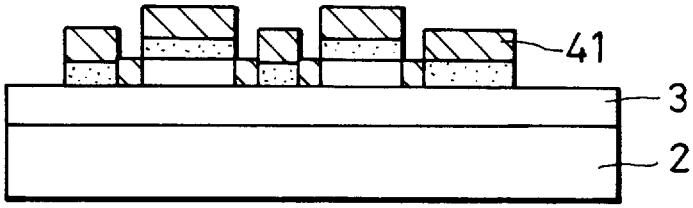
Figure 23A:
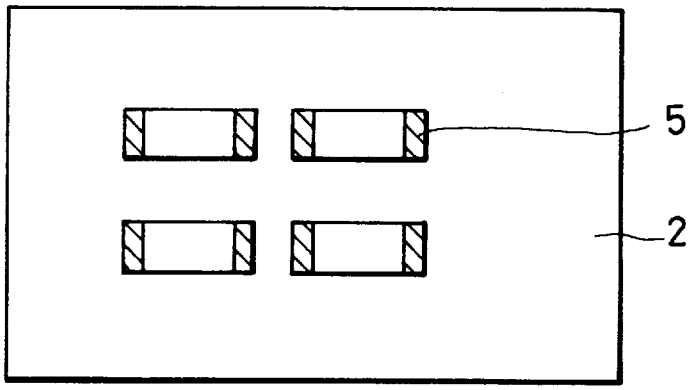
Figure 23B:
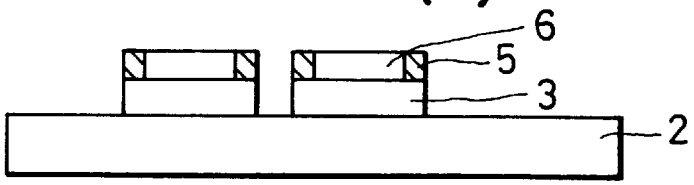

As shown in FIG. 21, a resist 40 for plating with a desired pattern is formed by printing on the transparent protective layer 6. The pattern of the resist 40 causes the portions for the electrodes 5 and 5', which are opposite from each other and which are to be formed according to a following step, to be openings and covers (1) a portion reserved for the connection of the transparent substrate 2 with the transparent protective plastic member 7 formed according to a following step, (2) the upper surface of the transparent protective layer 6 and (3) other portions unnecessary for plating. As shown in FIG. 22, a metallic plating layer 41 is formed by plating. As shown in FIG. 23, removed are the extra portions of the transparent conductive layer 3 or portions of the transparent conductive layer 3 except the portions where the transparent protective layer 6 and the electrodes 5 are formed.

Figure 24A:
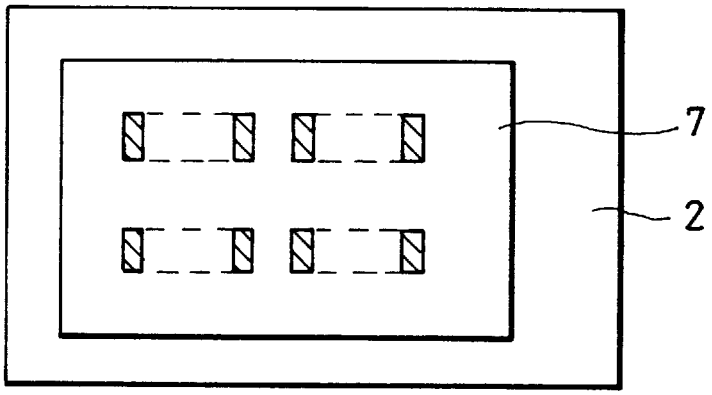
Figure 24B:
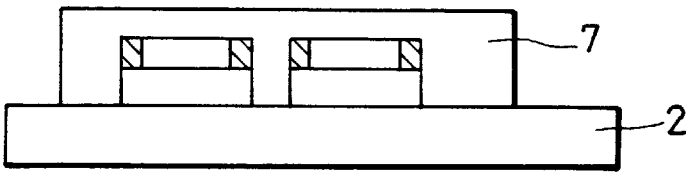

As shown in FIG. 24, a transparent protective plastic member 7 is formed on condition that the upper surface of the electrodes 5 and the transparent protective layer 6 and the end faces of the transparent conductive layer 3 and the electrodes 5 are covered and the transparent protective plastic member 7 is joined to the upper surface of the transparent substrate 2.

Figure 25A:
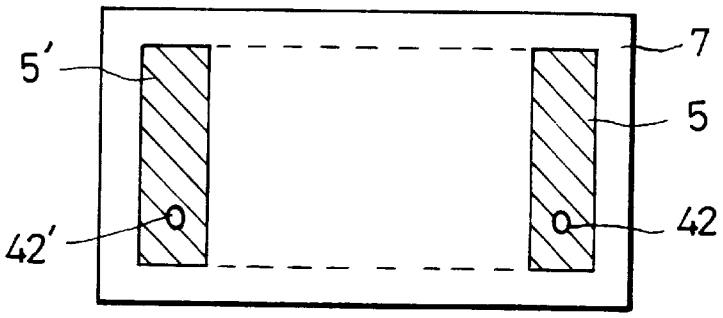
Figure 25B:
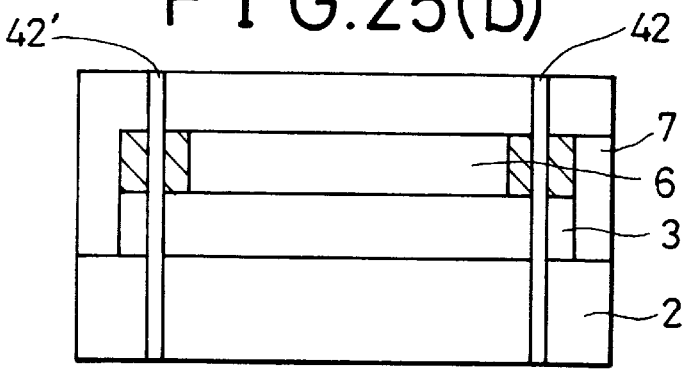
Figure 26A:
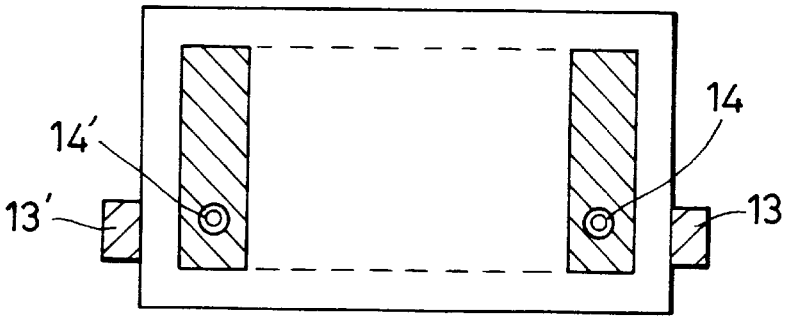
Figure 26B:
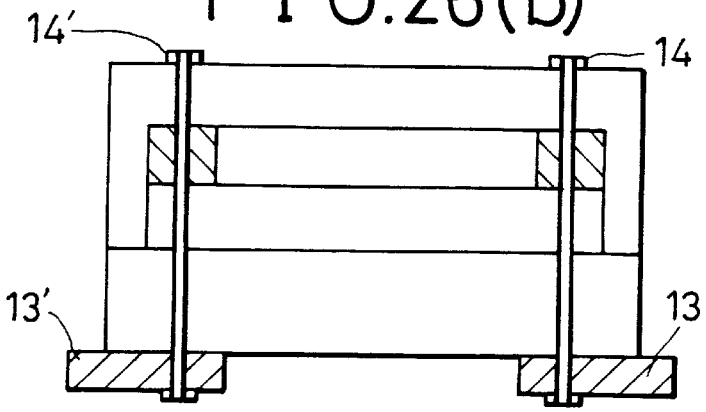

As shown in FIG. 25 (enlarged view), rapping or cutting is carried out for every transparent heater panel. The rapping is not only for cutting off in a junction of the transparent protective plastic member 7 and a portion of the transparent substrate 2 from which the transparent conductive layer 3 is removed but also for forming holes 42 and 42' for eyelets 14 and 14'. As shown in FIG. 26, outerly connected metal tabs 13 and 13' are mounted on the electrode portions with eyelets 14 and 14'. The transparent heater panel of the present invention with the end faces of the transparent conductive layer 3 and the electrodes 5 which are corrosion treated with the transparent protective plastic member 7 is obtained according to the above-mentioned methods.

Figure 29:
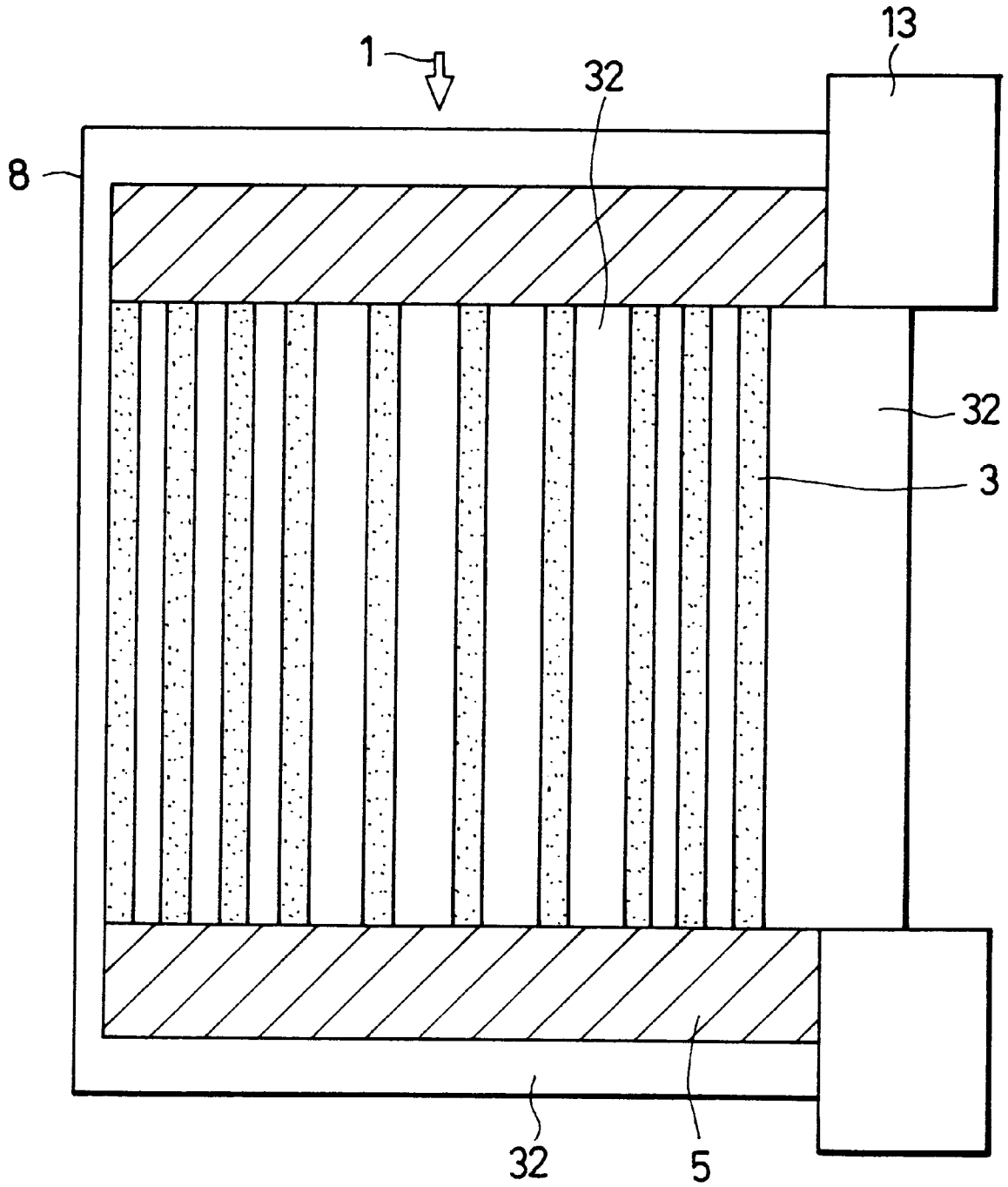
FIG. 29 is a plan view of a twelfth preferred embodiment of a transparent heater panel of the present invention whose transparent conductive layer in the form of a pattern.
Figure 30:
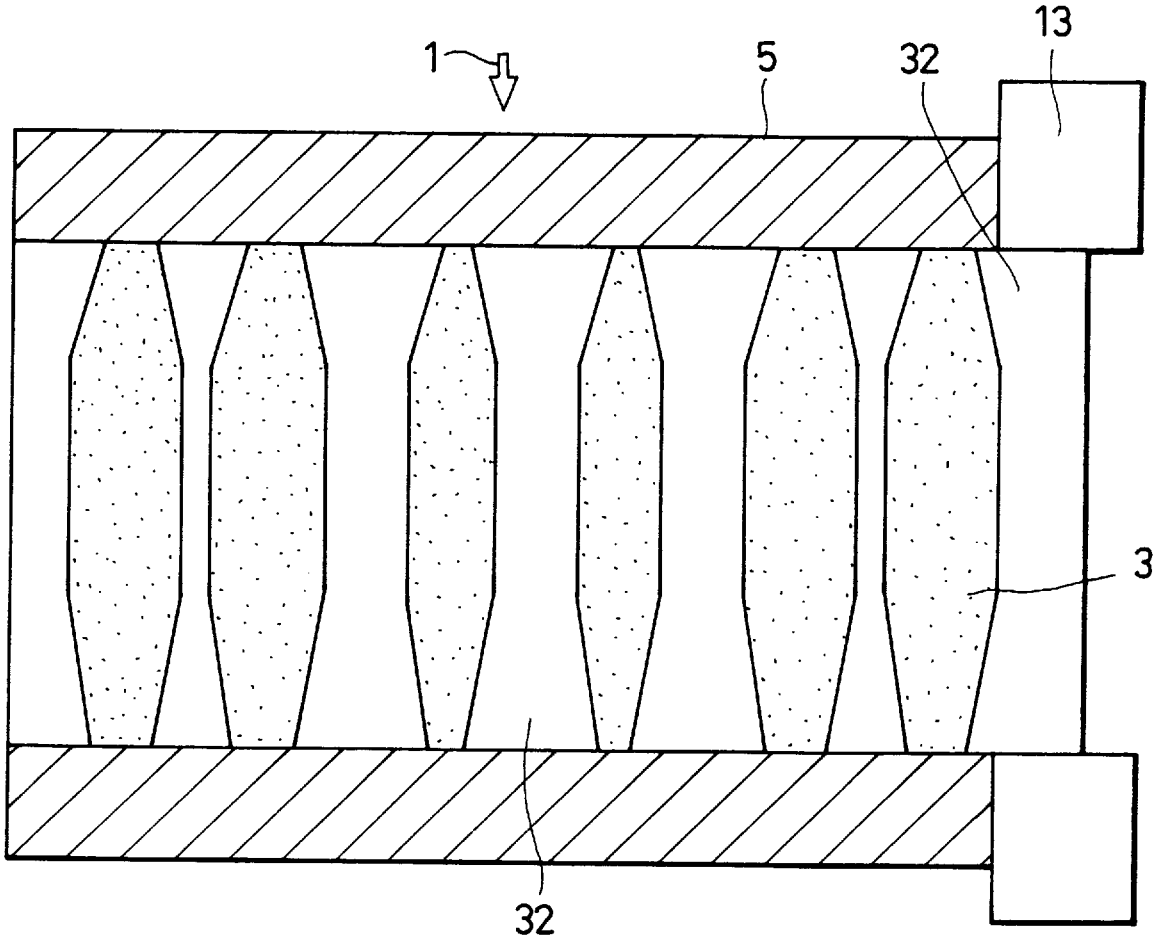
FIG. 30 is a plan view of a thirteenth preferred embodiment of a transparent heater panel of the present invention whose transparent conductive layer is in the form of a pattern.
Figure 31:
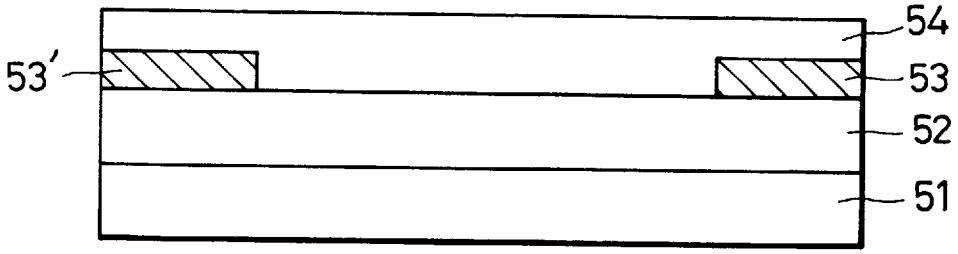
FIG. 31 is transverse sectional view illustrating a conventional embodiment of a transparent heater panel.

In a transparent conductive layer having any of patterns as described in FIGS. 29 and 30, a transparent protective plastic member 7 is also formed to produce a transparent heater panel with the corresponding pattern, according to the same procedures of FIGS. 20 to 26.

Figure 27A:
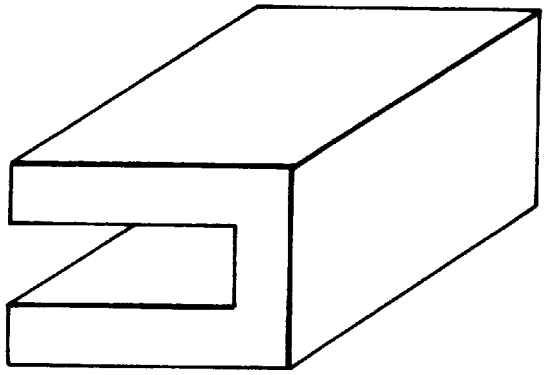
FIGS. 27 (*a*),(*b*) are perspective views of second outerly connected metal tabs substituting for an eyelet.
Figure 27B:
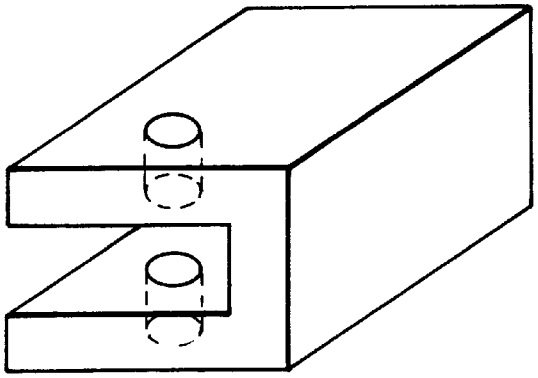
Figure 28:
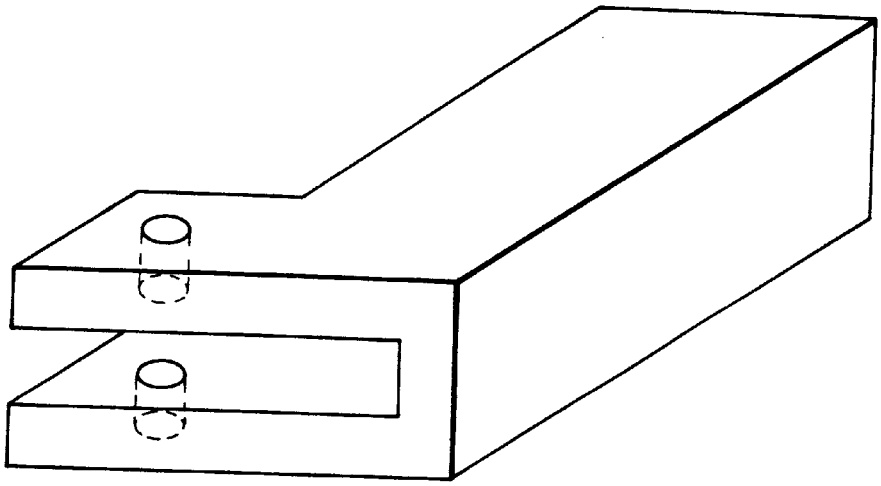
FIG. 28 is a perspective view of a third outerly connected metal tab substituting for an eyelet.

Moreover, fittings for connecting described in FIGS. 27 and 28 may be used as a substitute for the eyelet. A second outerly connected metal tab as shown in FIG. 27 is a fitting which has two plates opposite from each other. An electrode portion is held between the two plates and then they are joined together by mechanical pressure alone, mechanical pressure and heating in combination or mechanical pressure and resistance welding in combination to fix the metal tab to the electrode portion. Each of the plates of the metal tab may have a hole for a strand. When the strand is passed through the hole, the strand may be fixed to the metal tab by soldering. A third outerly connected metal tab as shown in FIG. 28 is a fitting similar to the fitting of FIG. 27.

The resist 40 is used in the preparation process of the present invention mentioned above. If the resist is common, there is no limit to the type. Preferable types of resists include an etching resist of alkali peeling or solution peeling, a plating resist, a cave-filling ink, a solder resist and an active resist. Typical examples include photoresists such as negative photoresists based on a cyclized rubber or polycinnamic acid and positive photoresists based on phenol or cresol novolak resins, thermosetting solder resists resulting from such as melamine resins, epoxy resins and imide modified resins, UV-setting solder resists resulting from radical or cation polymerization and a dry film resist. X-ray resists such as positive X-ray resists based on methacrylate copolymers and negative X-ray resists based on acrylate, and electron-beam resists such as positive electron-beam resists based on methacrylate or its copolymers and negative electron-beam resists resulting from photoresists, silicone resins, epoxy polymers and polysiloxane may be used.

The present invention will be described in detail in reference to examples. The scope of the present invention, however, should not be limited to these examples.

Example 1

A laminated layer comprising silver(10 nm)/copper (1 nm)/silicon nitride(30 nm)/indium oxide(60 nm) was formed on a polyethylene terephthalate (PET) film having a visible light transmission of 89% and a thickness of 100 $\mu$m using a reactive DC magnetron sputtering method to obtain a transparent conductive film. The thus-obtained transparent conductive film had a visible light transmission of 76% and a surface resistivity of 7 Ω/○. (a first intermediate product)

Onto the transparent conductive layer except a portion reserved for the connection of the transparent substrate with a transparent protective plastic member, portions reserved for the formation of the electrodes of a transparent heater panel and electrode portions for plating, a UV-setting transparent urethane acrylate (Mitsubishi Rayon Co., Trade Name; Diabeam UK-6074) was applied and then cured to form a transparent protective layer having a thickness of 10 $\mu$m. (a second intermediate product)

A resist was formed on the portion reserved for the connection of the transparent substrate with the transparent protective plastic member. (a third intermediate product) Electroplating was carried out in a nickel sulfamate plating bath at pH 4.5 to form nickel layers having a thickness of 5

μm as metal electrodes. (a fourth intermediate product) The fourth intermediate product was dipped into a 1% KOH aqueous solution to remove the resist and then was dipped into an 8% HCl aqueous solution to remove the extra portions. (a fifth intermediate product) The dimensions of the electrodes were: length 125 mm and width 4 mm, and the distance between the electrodes was 90 mm.

A transparent urethane acrylate layer (Diabeam UK-6074) having a thickness of 20 μm was formed on portions except portions which corresponded to connecting sections connected with outer electrodes to form a transparent protective plastic member. Cutting was carried out in a portion where the transparent substrate whose transparent conductive layer had been removed and the transparent protective plastic member were joined together. Outerly connected metal tabs were mounted with eyelets on portions which corresponded to connecting sections connected with outer electrodes and where no transparent protective plastic member was formed. A transparent heater panel was produced on condition that the transparent protective plastic member was formed on the exothermic surface in addition to the end faces of the transparent conductive layer and the peripheral end faces, as described in FIGS. 1 to 4. A pressure sensitive adhesive layer with a separator, a release sheet, was applied onto the transparent substrate to complete a transparent heater panel. The resistance between both electrodes was 5 Ω.

The separator was peeled from the transparent heater panel. The transparent heater panel was joined onto a glass plate and placed with the glass plate in a thermostatic tank at −20° C. An electric power of 13 V was applied thereto and the surface temperature of the transparent heater panel increased up to +2° C. in one minute. There was a temperature rise of 22° C.

The heater panel was dipped into a 1N HCl aqueous solution and allowed to stand for one hour but there was no change in the exterior appearance of its end faces. A high temperature and high humidity test under conditions of 85° C.×95% was carried out for 2,000 hours but there was no change in the exterior appearance of its end faces. An electric power of 13 V was applied to between the electrodes to pass an electric current for one minute. The temperature distribution due to the generation of heat was checked with an infrared thermometer. (Japan Avionics Co., Trade Name; Avio) (hereinafter referred to as a thermal test) During the thermal test, the transparent heater panel continued to generate heat without problems.

Example 2

A laminated layer comprising silicon nitride (50 nm)/silver(10 nm)/silicon oxynitride(60 nm) was formed on a PET film having a visible light transmission of 89% and a thickness of 100 μm using a reactive DC magnetron sputtering method to obtain a transparent conductive film. (a first intermediate product)

Onto the transparent conductive layer except a portion reserved for the connection of the transparent substrate with a transparent protective plastic member, portions reserved for the formation of the electrodes of a transparent heater panel and electrode portions for plating, the same UV-setting transparent urethane acrylate as used in Example 1 was applied and then cured to form a transparent protective layer having a thickness of 10 μm. (a second intermediate product)

A resist was formed on the portion reserved for the connection of the transparent substrate with the transparent protective plastic member. (a third intermediate product) The portions reserved for the formation of the electrodes were coated with a conductive paste containing copper fillers (phenolic resin binder) and allowed to stand at 150° C. for 30 minutes to form a conductive layer having a thickness of 15 μm (resistivity $6\times10^{-5}$ Ω·cm). The conductive layer was washed with an HCl aqueous solution having a pH of 2 and then with water.

Electroplating was carried out in an alkanol sulfonic acid bath at pH 1 to form soft solder layers having a thickness of 5 μm and consisting of an alloy of tin and lead as metal electrodes. (a fourth intermediate product) The fourth intermediate product was treated according to the same method as that in Example 1 to remove the resist and then was dipped into an 8% HCl aqueous solution. The extra portions were cut off to complete an original film of a transparent heater panel. (a fifth intermediate product)

A 25 μm thick PET film with an 8 μm thick adhesive layer of polyester was superposed on the exothermic surface on condition that the exothermic surface and the adhesive layer stood opposite each other. An area where a portion of the PET film was superposed on a portion of the transparent substrate whose transparent conductive layer had been removed was held at 100° C. for 30 seconds, followed by junction.

Cutting was carried out in a portion where the portion of the transparent substrate whose transparent conductive layer had been removed and the PET film as a transparent protective plastic film were joined together. Outerly connected metal tabs were mounted with eyelets on the electrode portions form a transparent heater panel where the exothermic surface in addition to the end faces of the transparent conductive layer and the peripheral end faces was covered by the transparent protective plastic film. The dimensions of the electrodes were: length 125 mm and width 4 mm, and the distance between the electrodes was 90 mm. The resistance between both electrodes was 5 Ω.

The transparent heater panel was placed in a thermostatic tank at −20° C. An electric power of 13 V was applied thereto and the surface temperature of the transparent heater panel increased up to +2° C. in one minute. There was a temperature rise of 22° C.

The heater panel was dipped into a 1N HCl aqueous solution and allowed to stand for one hour but there was no change in the exterior appearance of its end faces. A high temperature and high humidity test under conditions of 85° C.×95% was carried out for 2,000 hours but there was no change in the exterior appearance of its end faces. During the same thermal test as adapted in Example 1 after that, the transparent heater panel continued to generate heat without problems.

Example 3

A laminated layer comprising indium oxide (40 nm)/silver (10 nm)/indium oxide(60 nm) was formed on a PET film having a visible light transmission of 89% and a thickness of 100 μm using a reactive DC magnetron sputtering method to obtain a transparent conductive film. (a first intermediate product)

Onto the transparent conductive layer except a portion reserved for the connection of the transparent substrate with a transparent protective plastic member, portions reserved for the formation of the electrodes of a transparent heater panel and electrode portions for plating, the same UV-setting transparent urethane acrylate as used in Example 1 was applied and then cured to form a transparent protective layer having a thickness of 10 μm. (a second intermediate product)

A resist was formed on the portion reserved for the connection of the transparent substrate with the transparent protective plastic member. (a third intermediate product) The portions reserved for the formation of the electrodes were coated with a conductive paste containing copper fillers (acrylic resin binder, Mitsui Toatsu Chemicals Inc., Trade Name; MSP-600F) and allowed to stand at 140° C. for 30 minutes to form a conductive layer having a thickness of 10 μm (resistivity $6\times10^{-5}$ Ω·cm). (a fourth intermediate product)

A 25 μm thick copper foil having an adhesive layer on one surface of its own was joined to the fourth intermediate product through the adhesive layer. The upper surface of the copper foil was coated with the above-mentioned conductive paste (acrylic resin binder) and allowed to stand at 140° C. for 30 minutes to form a conductive layer having a thickness of 10 μm (resistivity $6\times10^{-5}$ Ω·cm). The extra portions were removed to complete an original film of a transparent heater panel whose transparent conductive layer was not covered.

An OPP (oriented polypropylene) film having a hole in a portion which corresponded to a connecting section connected with an outer electrode was superposed on the original film of the transparent heater panel on condition that the hole was superposed on the electrode portion. Another OPP film without a hole was superposed on the surface of the transparent substrate. The two OPP films were joined together in the peripheral portions of the original film under heating condition. The extra portions were removed to complete the transparent heater panel.

The transparent heater panel was placed in a thermostatic tank at −20° C. An electric power of 13 V was applied thereto and the surface temperature of the transparent heater panel increased up to +2° C. in one minute. There was a temperature rise of 22° C.

The heater panel was dipped into a 1N HCl aqueous solution and allowed to stand for one hour but there was no change in the exterior appearance of its end faces. A high temperature and high humidity test under conditions of 85° C.×95% was carried out for 2,000 hours but there was no change in the exterior appearance of its end faces. During the same thermal test as adapted in Example 1 after that, the transparent heater panel continued to generate heat without problems.

Example 4

A laminated layer comprising silicon nitride (30 nm)/titanium(1 nm)/silver having 15% by weight of gold(10 nm)/silicon nitride(30 nm)/indium oxide(30 nm) was formed on a PET film having a visible light transmission of 89% and a thickness of 100 μm using a reactive RF ion plating method to obtain a transparent conductive film. (a first intermediate product) The thus-obtained transparent conductive film had a visible light transmission of 74% and a surface resistivity of 7 Ω/○. Then, a transparent heater panel was produced according to the same method as that in Example 1.

The heater panel was dipped into a 1N HCl aqueous solution and allowed to stand for one hour but there was no change in the exterior appearance of its end faces. A high temperature and high humidity test under conditions of 85° C.×95% was carried out for 2,000 hours but there was no change in the exterior appearance of its end faces. During the same thermal test as adapted in Example 1 after that, the transparent heater panel continued to generate heat without problems.

Example 5

Onto one surface of a polycarbonate (PC) film having a thickness of 100 μm, a thermosetting polyurethane layer (10 nm thick, Mitsui Toatsu Chemicals Inc., Trade Name; Olester UD101N) and a polyvinyl alcohol layer (8 nm thick) were formed in order. A thermosetting silicone resin layer (20 μm thick, Dow Corning Toray Silicone Co., Trade Name; SR2410) was formed on the polyvinyl alcohol layer to produce a moistureproofing and gas-barrier film.

The oxygen permeability of the film checked according to the method, ASTM-D1434, was 0.5 cc $m^{-2}$ $day^{-1}$. The oxygen permeability at a relative humidity of 100% checked according to the method, ASTM-D3985, was 0.6 cc $m^{-2}\cdot day^{-1}$ or less. The water vapor permeability of the film checked according to the method, ASTM-E96 (38° C., 90% RH) was 0.2 g $m^{-2}\cdot day^{-1}$.

A 25 μm thick adhesive layer was formed on the transparent substrate of the moistureproofing and gas-barrier film. The moistureproofing and gas-barrier film was applied onto the exothermic surface of the original film for the transparent heater panel produced in Example 2. Cutting was carried out in a portion where the portion of the transparent substrate whose transparent conductive layer had been removed and a transparent protective plastic member were joined together. Outerly connected metal tabs were mounted with eyelets on the electrode portions to form a transparent heater panel where the end faces of the transparent conductive layer and the peripheral end faces to the exothermic surface were covered by the transparent protective member.

The transparent heater panel was placed in a thermostatic tank at −20° C. An electric power of 13 V was applied thereto and the surface temperature of the transparent heater panel increased up to +2° C. in one minute. There was a temperature rise of 22° C. A high temperature and high humidity test under conditions of 85° C.×95% was carried out for 1,000 hours but there was no change in the exterior appearance of its end faces. During the same thermal test as adapted in Example 1 after that, the transparent heater panel continued to generate heat without problems.

Example 6

The same procedure as that in Example 2 was carried out except that the transparent conductive layer was replaced by a laminated layer consisting of ITO (indium tin oxide, 10 Ω/○) to produce a transparent heater panel. The heater panel was dipped into a 1N HCl aqueous solution and allowed to stand for one hour but there was no change in the exterior appearance of its end faces.

Comparative Example 1

A transparent heater panel was produced under the same conditions as those in Example 1 except that a transparent protective plastic member was not formed. The heater panel was dipped into a 1N HCl aqueous solution and allowed to stand for one hour. The end faces were, however, covered by colored spots and partially peeled. A high temperature and high humidity test under conditions of 85° C.×95% was carried out but after 500 hours, colored spots appeared in the end faces. After additional 500 hours, colored spots were in the neighborhood of the center and the product could not be used as the transparent heater panel.

Comparative Example 2

A transparent heater panel was produced under the same conditions as those in Example 3 except that a transparent protective plastic member was not formed. A high temperature and high humidity test under conditions of 85° C.×95% was carried out but after 500 hours, colored spots appeared in the end faces. Colored spots were in some internal portions of the heater panel and the product could not be used as the transparent heater panel.

Comparative Example 3

A transparent heater panel was produced under the same conditions as those in Example 4 except that a transparent protective plastic member was not formed. The heater panel was dipped into a 1N HCl aqueous solution and allowed to stand for one hour. The end faces were covered by colored spots and partially peeled.

Comparative Example 4

A transparent heater panel was produced under the same conditions as those in Example 6 except that a transparent protective plastic member was not formed. The heater panel was dipped into a 1N HCl aqueous solution and allowed to stand for one hour. Part of the transparent conductive layer over the edge portions of the transparent heater panel melted away.

Example 7

A laminated layer comprising silicon nitride(30 nm)/silver(10 nm)/copper(1 nm)/silicon nitride(10 nm)/indium oxide(60 nm) was formed on a PET film having a visible light transmission of 89% and a thickness of 100 μm using a reactive RF magnetron sputtering method to obtain a transparent conductive film. (a first intermediate product) The thus-obtained transparent conductive film had a visible light transmission of 74% and a surface resistivity of 7 Ω/○.

Onto the laminated layer except electrode portions for plating and portions reserved for the electrodes of a transparent heater panel, the same UV-setting transparent urethane acrylate as used in Example 1 was applied and then cured to form a transparent protective layer having a thickness of 10 μm. (a second intermediate product)

The portions reserved for the formation of the electrodes were coated with a conductive paste containing copper fillers (phenolic resin binder) and allowed to stand at 160° C. for 30 minutes to form a conductive layer having a thickness of 10 μm (resistivity $6\times10^{-5}$ Ω·cm). (a third intermediate product)

Electroplating was carried out in a nickel sulfamate plating bath at pH 4.5 to form nickel layers having a thickness of 5 μm as metal electrodes. The dimensions of the electrodes were: length 125 mm and width 4 mm and the distance between the electrodes was 90 mm. (a fourth intermediate product)

A 25 μm thick PET film with a 20 μm-thick pressure sensitive adhesive layer was laminated on the fourth intermediate product on condition that the connecting sections of the electrodes were not covered, so that a transparent plastic member was formed. A pressure sensitive adhesive layer with a separator, or a release sheet, was applied onto the transparent substrate to complete the transparent heater panel. The resistance between both of the electrodes was 5 Ω.

The separator was peeled from the transparent heater panel. The transparent heater panel was joined onto a glass plate and placed with the glass plate in a thermostatic tank at −20° C. An electric power of 13 V was applied thereto and the surface temperature of the transparent heater panel increased up to +2° C. in one minute. There was a temperature rise of 22° C.

The end faces of the transparent heater panel or the cut end faces thereof were coated with a modified vinylacetate resin containing 5% by weight of 1,2,3-benzotriazole to form a layer having a thickness of 5 μm. The heater panel was allowed to stand at 110° C. for 5 minutes to form an organic protective layer containing an anticorrosive.

The heater panel was dipped into a 1N HCl aqueous solution and allowed to stand for one hour but there was no change in the exterior appearance of its end faces. A high temperature and high humidity test under conditions of 85° C.×95% was carried out but after 2,000 hours, there was no change in the exterior appearance of its end faces. During the same thermal test as adapted in Example 1 after that, the transparent heater panel continued to generate heat without problems.

Example 8

A laminated layer comprising silicon nitride(50 nm)/silver(10 nm)/silicon oxynitride(60 nm) was formed on a PET film having a visible light transmission of 89% and a thickness of 100 μm using a reactive RF magnetron sputtering method to obtain a transparent conductive film. (a first intermediate product)

Onto the exothermic surface of the transparent heater panel or the thus-obtained laminated layer, the same UV-setting transparent urethane acrylate as used in Example 1 was applied and then cured to form a transparent protective layer.

The portions reserved for the formation of the electrodes were coated with a conductive paste containing copper fillers (phenolic resin binder) and allowed to stand at 150° C. for 30 minutes to form a conductive layer having a thickness of 10 μm (resistivity $6\times10^{-5}$ Ω·cm). (a second intermediate product)

The second intermediate product was washed with an acid solution at pH 2 and then with water. Electroplating was carried out in an alkanol sulfonic acid bath at pH 1 to form solder layers having a thickness of about 5 μm and consisting of an alloy of tin and lead as metal electrodes. The dimensions of the electrodes were: length 125 mm and width 4 mm and the distance between the electrodes was 90 mm. The resistance between both of the electrodes was 5 Ω.

The transparent heater panel was placed in a thermostatic tank at −20° C. and allowed to stand. An electric power of 13 V was applied thereto and the surface temperature of the transparent heater panel increased up to +2° C. in one minute. There was a temperature rise of 22° C.

The peripheral end faces of the transparent heater panel in addition to the end faces of the transparent conductive layer were coated with a coating material (Clear for edge coating, Kawakami Paint Mfg. Co., Trade Name; Eton 2100) and dried to form a 50 μm thick organic protective layer containing an anticorrosive.

A high temperature and high humidity test under conditions of 85° C.×95% was carried out using the transparent heater panel but even after 1,000 hours, there was no change. During the same thermal test as adapted in Example 1 after that, the transparent heater panel continued to generate heat without problems.

Example 9

A laminated layer comprising indium oxide(40 nm)/silver(10 nm)/indium oxide(60 nm) was formed on a PET film having a visible light transmission of 89% and a thickness of 100 μm using a reactive RF magnetron sputtering method to obtain a transparent conductive film. (a first intermediate product)

Onto the laminated layer except electrode portions for plating and portions for the formation of the electrodes of a transparent heater panel, the same UV-setting transparent urethane acrylate as used in Example 1 was applied and then cured to form a transparent protective layer having a thickness of 10 μm. (a second intermediate product)

The portions reserved for the formation of the electrodes were coated with a conductive paste containing silver fillers (acrylic resin binder) and allowed to stand at 140° C. for 30 minutes to form a conductive layer having a thickness of 10 μm (resistivity $6\times10^{-5}$ Ω·cm). (a third intermediate product) A copper foil having an adhesive layer on one surface of its own was joined to the third intermediate product through the adhesive layer. The upper surface of the copper foil was coated with the above-mentioned conductive paste (acrylic resin binder) and allowed to stand at 140° C. for 30 minutes to form a conductive layer having a thickness of 10 μm (resistivity $6\times10^{-5}$ Ω·cm) as electrodes. (a fourth intermediate product) A 25 μm thick PET film with a 20 μm thick pressure sensitive adhesive layer was laminated on the fourth intermediate product on condition that the connecting sections of the electrodes were not covered, so that a transparent plastic member was formed.

The peripheral end faces of the transparent heater panel in addition to the end faces of the transparent conductive layer were coated with a UV-setting sealing material (modified acrylate, Trade Name; Rocktight 350) and dried to form a 50 μm thick organic protective layer containing an anticorrosive.

The heater panel was dipped into a 1N HCl aqueous solution and allowed to stand for one hour but there was no change in the exterior appearance of its end faces. A high temperature and high humidity test under conditions of 85° C.×95% was carried out but after 1,000 hours, there was no change in the exterior appearance of its end faces. During the same thermal test as adapted in Example 1 after that, the transparent heater panel continued to generate heat without problems.

Example 10

A laminated layer comprising silver(10 nm)/copper(1 nm)/silicon nitride(40 nm)/indium oxide(60 nm) was formed on a PET film having a visible light transmission of 89% and a thickness of 100 μm using a reactive RF magnetron sputtering method to obtain a transparent conductive film. (a first intermediate product) The thus-obtained transparent conductive film had a visible light transmission of 76% and a surface resistivity of 7 Ω/○. The surface of the thus-obtained laminated layer except electrode portions for plating and portions reserved for the formation of the electrodes of a transparent heater panel was coated with the same UV-setting transparent epoxy acrylate as that used in Example 1 to form a transparent protective layer having a thickness of 10 μm.

Electroplating was carried out in a nickel sulfamate plating bath at pH 4.5 to form nickel layers having a thickness of about 5 μm as metal electrodes. The dimensions of the electrodes were: length 125 mm and width 4 mm, and the distance between the electrodes was 90 mm. The resistance between both of the electrodes was 5 Ω.

The transparent heater panel was placed in a thermostatic tank at −20° C. and allowed to stand. An electric power of 13 V was applied thereto and the surface temperature of the transparent heater panel increased up to +2° C. in one minute. There was a temperature rise of 22° C.

The end faces of the transparent heater panel were coated with a modified vinylacetate resin containing 5% by weight of 1,2,3-benzotriazole to form a layer having a thickness of 5 μm. The heater panel was allowed to stand at 110° C. for 5 minutes to form an organic protective layer containing an anticorrosive.

The heater panel was dipped into a 1N HCl aqueous solution and allowed to stand for one hour but there was no change in the exterior appearance of its end faces. A high temperature and high humidity test under conditions of 85° C.×95% was carried out but after 1,000 hours, there was no change in the exterior appearance of its end faces. During the same thermal test as adapted in Example 1 after that, the transparent heater panel continued to generate heat without problems.

Comparative Example 5

A transparent heater panel was produced according to the same method as that in Example 7. The end faces of heater panel were not corrosion treated. It was dipped into a 1N HCl aqueous solution and allowed to stand for one hour. There were colored spots in its end faces and the end faces partially peeled.

Comparative Example 6

A transparent heater panel was produced according to the same method as that in Example 8. The end faces of heater panel were not corrosion treated. A high temperature and high humidity test under conditions of 85° C.×95% was carried out using the heater panel. After 500 hours, colored spots appeared in the end faces thereof. After additional 500 hours, colored spots appeared in the neighborhood of the center and the transparent heater panel could not be used.

Comparative Example 7

A transparent heater panel was produced according to the same method as that in Example 9. The end faces of heater panel were not corrosion treated. It was dipped into a 1N HCl aqueous solution and allowed to stand for one hour. There were colored spots in its end faces and the end faces partially peeled.

Example 11

A laminated layer comprising silver(10 nm)/copper(1 nm)/silicon oxynitride(5 nm)/silicon oxide(5 nm)/indium-tin oxide(40 nm) was formed on a PET film having a visible light transmission of 89% and a thickness of 100 μm using a reactive DC magnetron sputtering method with a metallic target to obtain a transparent conductive film. The thus-obtained transparent conductive film had a visible light transmission of 76% and a surface resistivity of 7 Ω/○. (a first intermediate product)

Onto the transparent conductive layer except a portion reserved for the connection of the transparent substrate with an anticorrosive layer, portions except conductive layers in the form of a pattern on an exothermic surface, portions reserved for the formation of the electrodes of a transparent heater panel and electrode portions for plating, the same UV-setting transparent urethane acrylate as used in Example 1 was applied and then cured to form a transparent protective layer having a thickness of 10 μm. (a second intermediate product)

A resist was formed on the portion reserved for the connection of the transparent substrate with the anticorrosive layer. (a third intermediate product) Electroplating was carried out in a nickel sulfamate plating bath at pH 4.5 to form nickel layers having a thickness of 5 μm as metal electrodes. (a fourth intermediate product) The fourth intermediate product was dipped into a 1% KOH aqueous solution to remove the resist and then was dipped into an HCl-type etching solution or an 8% HCl aqueous solution. The extra portions of the conductive layer were removed to form a group of conductive layers having a predetermined pattern in which the distance between lines of conductive layers was 200 μm in the center portion. (a fifth intermediate product; FIG. 30)

The dimensions of the electrodes were: length 125 mm and width 4 mm, and the distance between the electrodes was 90 mm. A transparent urethane acrylate layer (Diabeam UK-6074) having a thickness of 20 μm as an anticorrosive layer was formed on electrode portions except portions which corresponded to connecting sections connected with outer electrodes.

Cutting was carried out in a portion where the transparent substrate whose transparent conductive layer had been removed and the anticorrosive layer were joined together. By resistance welding outerly connected metal tabs were joined by heat to the electrode portions which corresponded to the connecting sections connected with the outer electrodes and where no anticorrosive layer was formed.

A pressure sensitive adhesive layer with a separator, or a release sheet, was applied onto the transparent substrate to complete a transparent heater panel with fittings for connection. The resistance between both electrodes formed was 5 Ω.

The separator was peeled from the transparent heater panel whose metal tabs were connected with conductors for applying electric power by soldering. The transparent heater panel was joined onto a glass plate and placed with the glass plate in a thermostatic tank at −20° C. An electric power of 13 V was applied thereto and the surface temperature of the transparent heater panel increased up to +2° C. in one minute. There was a temperature rise of 22° C. The temperature distribution of the exothermic surface was in the range of −1 and uniform.

The heater panel was dipped into a 1N HCl aqueous solution and allowed to stand for one hour but there was no change in the exterior appearance of its end faces. A high temperature and high humidity test under conditions of 85° C.×95% was carried out for 1,000 hours but there was no change in the exterior appearance of its end faces. During the thermal test as adapted in Example 1 after that, the transparent heater panel continued to generate heat without problems.

We claim:

1. A transparent heater panel comprising in combination:

(1) a transparent substrate;

(2) a transparent conductive layer formed on a first surface of the transparent substrate and having end faces;

(3) a first electrode extending over a first edge portion of the transparent conductive layer, and a second electrode extending over a second edge portion of the transparent conductive layer spaced from and opposite from the first edge portion thereof, said electrodes having end faces; and (4) a transparent protective layer formed over the portion of the transparent conductive layer, where neither the first electrode nor the second electrode is to be formed, each of the end faces of the transparent conductive layer being anticorrosion treated.

2. A transparent heater panel according to claim 1, wherein the transparent conductive layer is in the form of a predetermined pattern and functions as an exothermic surface.

3. A transparent heater panel according to claim 1, wherein each of the end faces of the electrodes and each of the end faces of the transparent protective layer are anticorrosion treated.

4. A transparent heater panel according to claim 2, wherein the transparent conductive layer comprises at least one transparent thin layer and at least one metallic thin layer whose principal component is at least one metal selected from the group consisting of silver and copper.

5. A transparent heater panel according to claim 4, wherein the transparent thin layer is a lamina or a laminate comprising at least one material selected from the group consisting of metallic oxides, metallic nitrides, metallic oxynitrides, metallic hydronitrides and metallic carbides.

6. A transparent heater panel according to claim 4, wherein the metallic thin layer comprises a first metallic thin layer (A) and a second metallic thin layer (B) which each are over the transparent substrate in order of AB, BAB or BA;

the first metallic thin layer (A) being selected from the group consisting of (1) one of a lamina and a laminate comprising at least one metal selected from the group (a1) consisting of silver and copper;

(2) one of a lamina and a laminate comprising an alloy of at least one metal selected from the group (a1) and at least one metal selected from the group (a2) consisting of palladium, copper, platinum and gold; and (3) one of a lamina and a laminate consisting of a mixture of at least one metal selected from the group (a1) and at least one metal selected from the group (a2), the second metallic thin layer (B) being selected from the group consisting of (4) one of a lamina and a laminate comprising at least one metal selected from the group (b1) consisting of copper, nickel, tin, indium, titanium, palladium, aluminum, chromium, silicon, tungsten, vanadium, zinc, tantalum, gold, platinum and cobalt;

(5) one of a lamina and a laminate comprising an alloy of at least one metal selected from the group (b1); and (6) one of a lamina and a laminate of a mixture consisting of at least one metal selected from the group (b1).

7. A transparent heater panel according to claim 2, wherein each of the end faces of the transparent protective layer is anticorrosion treated with a transparent protective plastic member.

8. A transparent heater panel according to claim 7, wherein the transparent protective plastic member is a transparent protective plastic film or a transparent protective plastic sheet.

9. A transparent heater panel according to claim 7, wherein the transparent protective plastic member is laminated through the use of an adhesive layer.

10. A transparent heater panel according to claim 7, wherein the transparent protective plastic member is laminated on all end faces of the transparent heater panel.

11. A transparent heater panel according to claim 2, wherein each of the end faces of the transparent conductive layer is anticorrosion treated with an anticorrosive.

12. A transparent heater panel according to claim 11, wherein the anticorrosive comprises one effective component selected from the group consisting of (1) at least one effective component selected from the group consisting of benzotriazole, indazoles, imidazoles and derivatives thereof;

(2) at least one effective component selected from the group consisting of amino acids, esters of amino acids, alkali metal salts of amino acids, ammonia and salts of amines;

(3) one effective component selected from the group consisting of mercaptan and derivatives of mercaptan which are closely related to mercaptan;

(4) one effective component comprising any of copper chelate compounds;

(5) a mixture comprising at least two of effective components (1) to (4); and (6) a mixture comprising at least one of effective components (1) to (4) and a third component.

13. A transparent heater panel according to claim 12, wherein an organic protective layer containing an anticorrosive comprising any of effective components (1) to (6) is formed on at least one of the end faces of the transparent conductive layer.

14. A transparent heater panel according to claim 12, wherein an adhesive layer containing an anticorrosive comprising any of effective components (1) to (6) is formed on at least one of the end faces of the transparent conductive layer.

15. A process for preparing a transparent heater panel which comprises, in combination:

(1) a transparent substrate;

(2) a transparent conductive layer formed on a first surface of the transparent substrate and having end faces;

(3) a first electrode extending over a first edge portion of the transparent conductive layer, and a second electrode extending over a second edge portion of the transparent conductive layer spaced from and opposite from the first edge portion thereof; and (4) a transparent protective layer formed over the portion of the transparent conductive layer, where neither the first electrode nor the second electrode is to be formed, the process comprising a step of anticorrosion treating each of the end faces of the transparent conductive layer.

16. A process for preparing a transparent heater panel having peripheral end faces which comprises (1) a first step of forming a transparent protective layer over a portion of a transparent conductive layer having end faces which is formed on a first surface of a transparent substrate and which functions as an exothermic surface;

(2) a second step of forming a resist over a portion of the transparent conductive layer which is to be covered with a transparent protective plastic member;

(3) a third step of forming a first electrode and a second electrode;

(4) a fourth step of removing the resist;

(5) a fifth step of removing a surplus of the transparent conductive layer;

(6) a sixth step of covering each of the end faces of the transparent conductive layer and each of the peripheral end faces of the transparent heater panel with the transparent protective plastic member; and (7) a seventh step of removing a surplus of the transparent heater panel.

17. A process for preparing a transparent heater panel according to claim 15, wherein the process further comprises (1) a first step of preparing in advance a transparent heater panel which is not covered with a transparent protective plastic member; and (2) a second step of covering each of the end faces of the transparent conductive layer, each of the peripheral end faces of the transparent heater panel and the first and second surfaces of the transparent heater panel with a transparent protective plastic member.

18. A transparent heater panel according to claim 1, wherein the transparent conductive layer comprises at least one transparent thin layer and at least one metallic thin layer whose principal component is at least one metal selected from the group consisting of silver and copper.

19. A transparent heater panel according to claim 18, wherein the transparent thin layer is a lamina or a laminate comprising at least one material selected from the group consisting of metallic oxides, metallic nitrides, metallic oxynitrides, metallic hydronitrides and metallic carbides.

20. A transparent heater panel according to claim 18, wherein the metallic thin layer comprises a first metallic thin layer (A) and a second metallic thin layer (B) which each are over the transparent substrate in order of AB, BAB or BA;

the first metallic thin layer (A) being selected from the group consisting of (1) one of a lamina and a laminate comprising at least one metal selected from the group (a1) consisting of silver and copper;

(2) one of a lamina and a laminate comprising an alloy of at least one metal selected from the group (a1) and at least one metal selected from the group (a2) consisting of palladium, copper, platinum and gold; and (3) on of a lamina and a laminate consisting of a mixture of at least one metal selected from the group (a1) and at least one metal selected from the group (a2), the second metallic thin layer (B) being selected from the group consisting of (4) one of a lamina and a laminate comprising at least one metal selected from the group (b1) consisting of copper, nickel, tin, indium, titanium, palladium, aluminum, chromium, silicon, tungsten, vanadium, zinc, tantalum, gold, platinum and cobalt;

(5) one of a lamina and a laminate comprising an alloy of at least one metal selected from the group (b1); and (6) one of a lamina and a laminate of a mixture consisting of a least one metal selected from the group (b1).

21. A transparent heater panel according to claim 1, wherein each of the end faces of the transparent protective layer is corrosion treated with a transparent protective plastic member.

22. A transparent heater panel according to claim 21, wherein the transparent protective plastic member is a transparent protective plastic film or a transparent protective plastic sheet.

23. A transparent heater panel according to 21, wherein the transparent protective plastic member is laminated through the use of an adhesive layer.

24. A transparent heater panel according to claim 21, wherein the transparent protective plastic member is laminated on all end faces of the transparent heater panel.

25. A transparent heater panel according to claim 1, wherein each of the end faces of the transparent conductive layer is anticorrosion treated with an anticorrosive.

26. A transparent heater panel according to claim 25, wherein the anticorrosive comprises one effective component selected from the group consisting of (1) at least one effective component selected from the group consisting of benzotriazole, indazoles, imidazoles and derivatives thereof;

(2) at least one effective component selected from the group consisting of amino acids, esters of amino acids, alkali metal salts of amino acids, ammonia and salts of amines;

(3) one effective component selected from the group consisting of mercaptan and derivatives of mercaptan which are closely related to mercaptan;

(4) one effective component comprising any of copper chelate compounds;

(5) a mixture comprising at least two of effective components (1) to (4); and (6) a mixture comprising at least one of effective components (1) to (4) and a third component.

27. A transparent heater panel according to claim 26, wherein an organic protective layer containing an anticorrosive comprising any of effective components (1) to (6) is formed on at least one of the end faces of the transparent conductive layer.

28. A transparent heater panel according to claim 26, wherein an adhesive layer containing an anticorrosive comprising any of effective components (1) to (6) is formed on at least one of the end faces of the transparent conductive layer.

* * * * *